US012022875B2

(12) United States Patent
Rosen et al.

(10) Patent No.: US 12,022,875 B2
(45) **Date of Patent: *Jul. 2, 2024**

(54) QUICK CONNECT ADAPTER AND ELECTRONIC VAPORIZER HAVING A CERAMIC HEATING ELEMENT HAVING A QUICK CONNECT ADAPTER

(71) Applicant: Dr. Dabber Inc., Las Vegas, NV (US)

(72) Inventors: Jamie Michael Rosen, Las Vegas, NV (US); Christopher Ortega, Las Vegas, NV (US); Pantelis Ataliotis, Las Vegas, NV (US)

(73) Assignee: Dr. Dabber Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/339,221

(22) Filed: Jun. 21, 2023

(65) Prior Publication Data

US 2024/0099387 A1 Mar. 28, 2024

Related U.S. Application Data

(63) Continuation of application No. 17/075,545, filed on Oct. 20, 2020, now Pat. No. 11,730,205.

(51) Int. Cl.

| | |
|---|---|
| ***A24F 40/485*** | (2020.01) |
| ***A24F 40/46*** | (2020.01) |
| ***A24F 40/57*** | (2020.01) |

(52) U.S. Cl.

CPC ..... *A24F 40/485* (2020.01); *A24F 40/46* (2020.01); *A24F 40/57* (2020.01)

(58) Field of Classification Search

CPC ..... A24F 40/40; A24F 40/46; A24F 40/57; A24F 7/02; A24F 1/30; A61M 11/04; A61M 15/06

(Continued)

(56) References Cited

U.S. PATENT DOCUMENTS

| | | | |
|---|---|---|---|
| 2,293,235 | A | 8/1942 | Zahner |
| 3,564,475 | A | 2/1971 | Fujii et al. |

(Continued)

FOREIGN PATENT DOCUMENTS

| | | | |
|---|---|---|---|
| EP | 3666318 | A1 | 6/2020 |
| WO | 2019122878 | A1 | 6/2019 |
| WO | 2019211339 | A1 | 11/2019 |

OTHER PUBLICATIONS

International Search Report and Written Opinion for International Patent Application No. PCT/US21/55847; mailed Jan. 25, 2022; 7 pages.

*Primary Examiner* — Christopher M Rodd
*Assistant Examiner* — Ronnie Kirby Jordan
(74) *Attorney, Agent, or Firm* — Endurance Law Group PLC; James R. Yee

(57) ABSTRACT

A vaporizer has a main unit, an atomizer, a mouthpiece and a quick connect adapter. The quick connect adapter includes a housing, air flow path, a quick release connector and an adapter connector. The housing defines an inner channel. The inner channel has a first open end and a second open end. The air flow path is defined by the housing to allow vapor to flow from the atomizer to the mouthpiece. The quick release connector is coupled to, and located adjacent, the first end of the housing. The quick release connecter is configured to allow the mouthpiece to be releasably coupled to the main unit via the quick connect adapter. The adapter connector coupled to, and located adjacent, the second end of the housing. The adapter connector is configured to allow the quick connect adapter to be releasably coupled to the main unit.

19 Claims, 19 Drawing Sheets

(58) Field of Classification Search
USPC ..... 131/324
See application file for complete search history.

(56) References Cited

U.S. PATENT DOCUMENTS

| | | | |
|---|---|---|---|
| 4,108,713 | A | 8/1978 | Weisz |
| 4,123,741 | A | 10/1978 | Kiyono et al. |
| 4,853,517 | A | 8/1989 | Bowen et al. |
| 4,859,835 | A | 8/1989 | Balderson |
| 5,522,008 | A | 5/1996 | Bernard |
| 5,557,704 | A | 9/1996 | Dennis et al. |
| 5,647,052 | A | 7/1997 | Patel et al. |
| 5,796,914 | A | 8/1998 | Gatzemeyer et al. |
| 6,037,574 | A | 3/2000 | Lanham et al. |
| 6,044,202 | A | 3/2000 | Junkel |
| 6,046,438 | A | 4/2000 | Slegt |
| 6,085,026 | A | 7/2000 | Hammons et al. |
| 6,150,636 | A | 11/2000 | Bogdanski et al. |
| 6,381,408 | B1 | 4/2002 | Jaworski et al. |
| 6,392,206 | B1 | 5/2002 | Von Arx et al. |
| 6,513,524 | B1 | 2/2003 | Storz |
| 7,002,114 | B2 | 2/2006 | He et al. |
| 7,469,844 | B2 | 12/2008 | Conway et al. |
| 7,475,684 | B2 | 1/2009 | Balch et al. |
| 7,544,332 | B2 | 6/2009 | De Silva et al. |
| 8,089,337 | B2 | 1/2012 | Brummell et al. |
| 8,281,514 | B2 | 10/2012 | Fleming |
| 8,364,028 | B1 | 1/2013 | Vaske et al. |
| 8,381,408 | B2 | 2/2013 | Dubois et al. |
| 8,693,852 | B2 | 4/2014 | Baraky |
| 8,783,888 | B2 | 7/2014 | McCavit et al. |
| 8,787,739 | B2 | 7/2014 | Hsiao |
| 8,879,898 | B2 | 11/2014 | Neumann |
| 8,891,947 | B2 | 11/2014 | Neumann et al. |
| 8,983,277 | B2 | 3/2015 | Hsiao |
| 9,031,392 | B2 | 5/2015 | Hsiao |
| 9,410,695 | B2 | 8/2016 | Hsiao |
| 9,655,168 | B2 | 5/2017 | Belongia et al. |
| 9,814,270 | B2 | 11/2017 | Montgomery |
| 10,064,969 | B2 | 9/2018 | Hsiao |
| 10,203,108 | B2 | 2/2019 | De Luca |
| 10,517,334 | B1 | 12/2019 | Volodarsky et al. |
| 10,588,356 | B2 | 3/2020 | Harrison et al. |
| 11,064,738 | B2 | 7/2021 | Rosen et al. |
| 2003/0217750 | A1 | 11/2003 | Amirpour et al. |
| 2004/0026411 | A1 | 2/2004 | Mucke et al. |
| 2005/0117895 | A1 | 6/2005 | Balch et al. |
| 2005/0145617 | A1 | 7/2005 | McMillin et al. |
| 2006/0283449 | A1 | 12/2006 | Balch et al. |
| 2015/0125136 | A1 | 5/2015 | Sanchez |
| 2015/0208729 | A1 | 7/2015 | Monsees et al. |
| 2015/0296879 | A1 | 10/2015 | Emarlou |
| 2016/0219937 | A1 | 8/2016 | Rado |
| 2016/0227837 | A1* | 8/2016 | Hammel et al. ..... A24F 47/008 |
| 2017/0055579 | A1 | 3/2017 | Kuna et al. |
| 2017/0251718 | A1 | 9/2017 | Armoush et al. |
| 2017/0347711 | A1 | 12/2017 | Litten et al. |
| 2019/0321569 | A1 | 10/2019 | Gough et al. |
| 2022/0117304 | A1 | 4/2022 | Rosen et al. |

* cited by examiner

QUICK CONNECT ADAPTER AND ELECTRONIC VAPORIZER HAVING A CERAMIC HEATING ELEMENT HAVING A QUICK CONNECT ADAPTER

CROSS REFERENCE TO RELATED APPLICATIONS

This application claims priority to U.S. patent application Ser. No. 17/075,545 filed on Oct. 20, 2020, the entire disclosure of which is hereby incorporated by reference and relied upon.

FIELD OF THE INVENTION

The present disclosure relates generally to electronic vaporizers for creating a vapor from an organic material, and more particularly, to quick connect adapters for use in electronic vaporizers having an embedded temperature sensor.

BACKGROUND OF THE INVENTION

Electronic vaporizers are devices used to aerosol an organic material, for a user to inhale the produced aerosol (vapor). The aerosol of the organic substance is most typically accomplished through the heating of organic volatile compounds of a material, being either solid or liquid based. The heating results in the phase-change of (at least a portion of) the organic volatile compounds, from their solid or liquid state, to a gas state, which can then be transferred into a user through direct inhalation. The heating can also result in the activation of organic compounds at temperatures below the vaporization temperature.

To increase the amount of vapor produced from the organic substance, an air restrictor can be used. This air restrictor will create a low-pressure zone around the organic material, which thereby reduces the energy required for the phase change, and results in denser vapor. A portable electronic vaporizer uses both the heating temperature along with airflow to control the resulting vapor from organic material.

The desire of most electronic vaporizers is a device that produces denser vapor, at lower temperatures, so that the user is not inhaling hot vapor which can be irritating to the user, and for the preservation of the flavors and experience produced by the heating of the organic volatile compounds. Too high of temperatures can result in secondary non-desirable reactions, such as breakdown of the organic volatile compounds, especially in a high temperature oxygen environment.

A desire among electronic vaporizers is accuracy and controllable heating temperatures, with the goal that the produced vapor is at an ideal temperature where vaporization occurs, but not at too high of a temperature that would result in vapor with excessive temperatures that could be irritating to the user, or too high where the vapor undergoes secondary reactions forming unwanted byproducts. Ideal and accurate heating temperatures are desired for both the flavor of the produced vapor, and the preservation of only vaporizing the organic compounds and not causing unwanted secondary reactions. Too high of temperatures can result in secondary non-desirable reactions, such as breakdown of the organic volatile compounds, especially in a high temperature oxygen environment. And too low of temperatures can result in only partially vaporizing the organic substance, or not producing any vapor at all. An ideal temperature should produce vapor, without the secondary non-desirable reactions that can alter the effects and flavor of the produced vapor.

Differentiation of portable electronic vaporizers is typically in the arrangement of certain components, or the method of heating, in an effort to produce the desired vapor output. A typical portable electronic vaporizer is composed of the following components: a heat source, a chamber to hold the organic material that is to be heated to produce vapor, the electronics to power the heat source, a portable power supply to power the system, and several optional components that have become the norm for many portable electronic vaporizers. The addition of a water filtration device that helps reduce the temperature of the produced vapor through the percolation of the vapor through water, and the addition of the air restrictor to help increase vapor density as described previously.

While portable electronic vaporizers may vary in their appearance, components and arrangements, it is desirable that vaporizers are easy to disassemble easily and quickly for purposes of cleaning, storage and transportation.

The present invention is aimed at solving one or more of the problems identified above.

SUMMARY OF THE INVENTION

In one aspect of the present invention, a quick connect adapter for use in an electronic vaporizer is provided. The electronic vaporizer has a main unit, an atomizer removably coupled to the main unit and a removable mouthpiece. The quick connect adapter includes a quick connect adapter housing, air flow path, a mouthpiece quick release connector and an adapter connector. The quick connect adapter housing defines an inner channel. The inner channel has a first open end and a second open end and is centered on a center axis. The air flow path is defined by the quick connect adapter housing to allow vapor to flow from the atomizer to the mouthpiece. The mouthpiece quick release connector is coupled to, and located adjacent, the first end of the quick connect adapter housing. The mouthpiece quick release connecter is configured to allow the mouthpiece to be releasably coupled to the main unit via the quick connect adapter. The adapter connector coupled to, and located adjacent, the second end of the quick connect adapter housing. The adapter connector is configured to allow the quick connect adapter to be releasably coupled to the main unit.

In another aspect of the present invention, an electronic vaporizer is provided. The electronic vaporizer includes a main unit, an atomizer, a quick connect adapter and a mouthpiece. The atomizer is coupled to the main unit. The quick connect adapter is removably coupled to the main unit. The atomizer is at least partially located within the quick connect adapter. The mouthpiece is removably coupled to the main unit via the quick connect adapter. The quick connect adapter includes a quick connect adapter housing, air flow path, a mouthpiece quick release connector and an adapter connector. The quick connect adapter housing defines an inner channel. The inner channel has a first open end and a second open end and is centered on a center axis. The air flow path is defined by the quick connect adapter housing to allow vapor to flow from the atomizer to the mouthpiece. The mouthpiece quick release connector is coupled to, and located adjacent, the first end of the quick connect adapter housing. The mouthpiece quick release connecter is configured to allow the mouthpiece to be releasably coupled to the main unit via the quick connect adapter. The adapter connector coupled to, and located adjacent, the second end of the quick connect adapter housing. The adapter connector is configured to allow the quick connect adapter to be releasably coupled to the main unit.

In still another aspect of the present invention, a base electronic unit contains the electronics and portable power supply and includes:

- buttons or other components that allow the user to adjust the settings of the device,
- A method to recharge the portable power supply, and
- electrical connections to connect the base device to an atomizer.

In a further aspect of the present invention, an atomizer that is removable from the base device is provided. The atomizer includes:

- a crucible chamber that holds the organic substance that is to be vaporized;
- a heating element that directly heats the crucible chamber;
- The electrical connections that connect the atomizer to the base electronic unit; and
- a single opening above the crucible chamber that allows the user to load material into the chamber, and also allows vapor out of the chamber.

In an additional aspect of the present invention, an adapter which is removable from the base device, that covers the atomizer, and includes:

- an air inlet that allows air to flow through the adapter;
- a method for the air inlet to increase airflow to mitigate or stop the production of vapor;
- a method for the adapter to be attached/removed easily from the base electronic unit in between uses;
- an outlet that allows for the escape of vapor either directly to the user, or to a water filtration device;
- a method of reducing the airflow either with or without a water filtration device; AND
- a water filtration device that is interchangeable with the adapter, that helps reduce the temperature of the vapor through percolation.

In one more additional aspect of the present invention, a method of producing vapor in a portable electronic vaporized by using the quick-connect adapter that is easily attached/removed from the device, to help control the airflow to the atomizer in an effort to adjust the vapor production from the heating of the atomizer. The quick-connect adapter is removed between uses, to load organic material into the atomizer crucible; and then attached to the device before the unit is operated; where air enters through the adapter, into the quick connect adapter, and then leaves out through another port of the quick connect adapter and possibly through the glass attachment.

BRIEF DESCRIPTION OF THE SEVERAL VIEWS OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified.

DETAILED DESCRIPTION OF THE INVENTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Figure 1A:
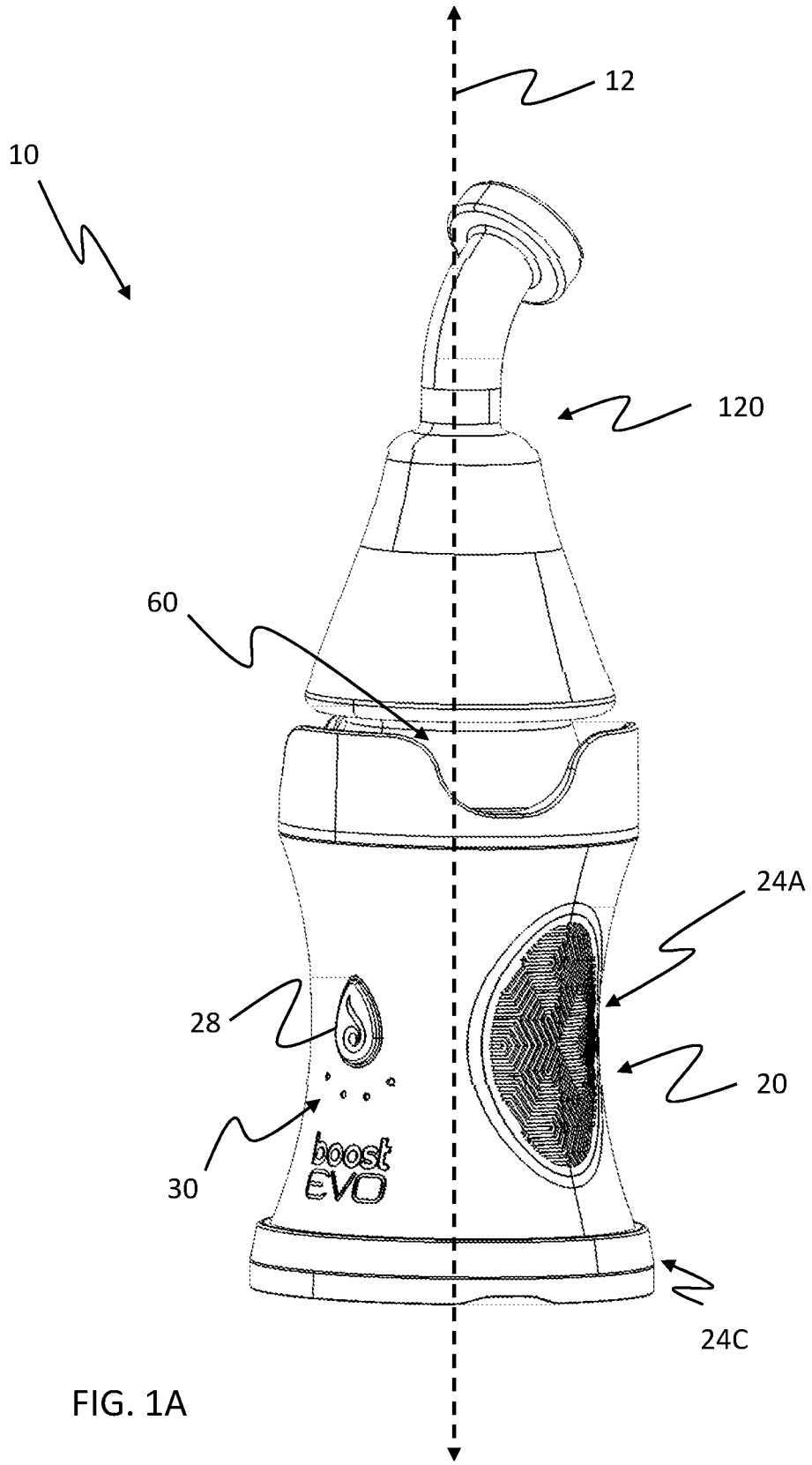
FIG. 1A is a perspective drawing of an electronic vaporizer, according to an embodiment of the present invention.
Figure 1B:
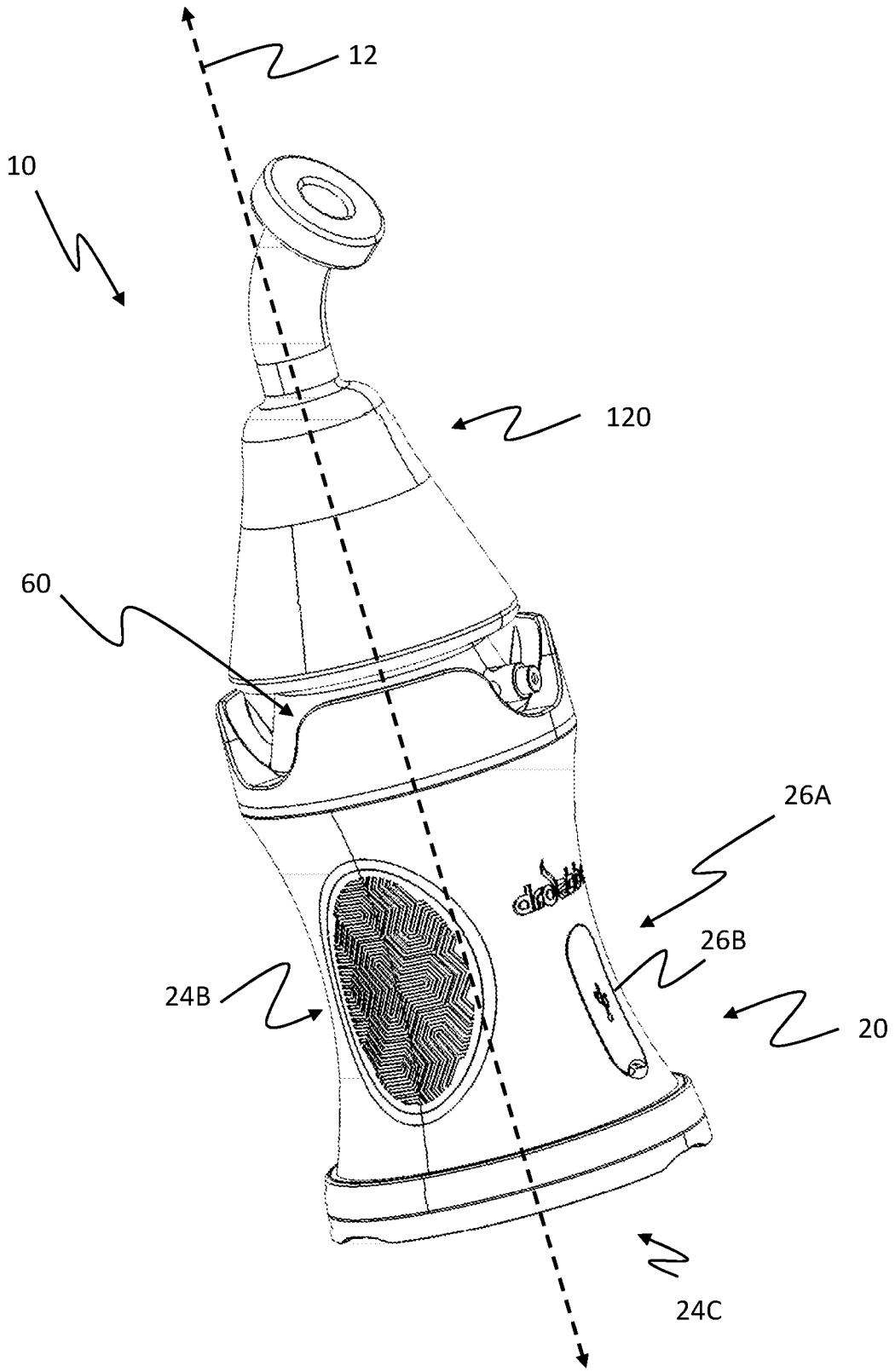
FIG. 1B is a second perspective drawing of the electronic vaporizer of FIG. 1A.
Figure 1C:
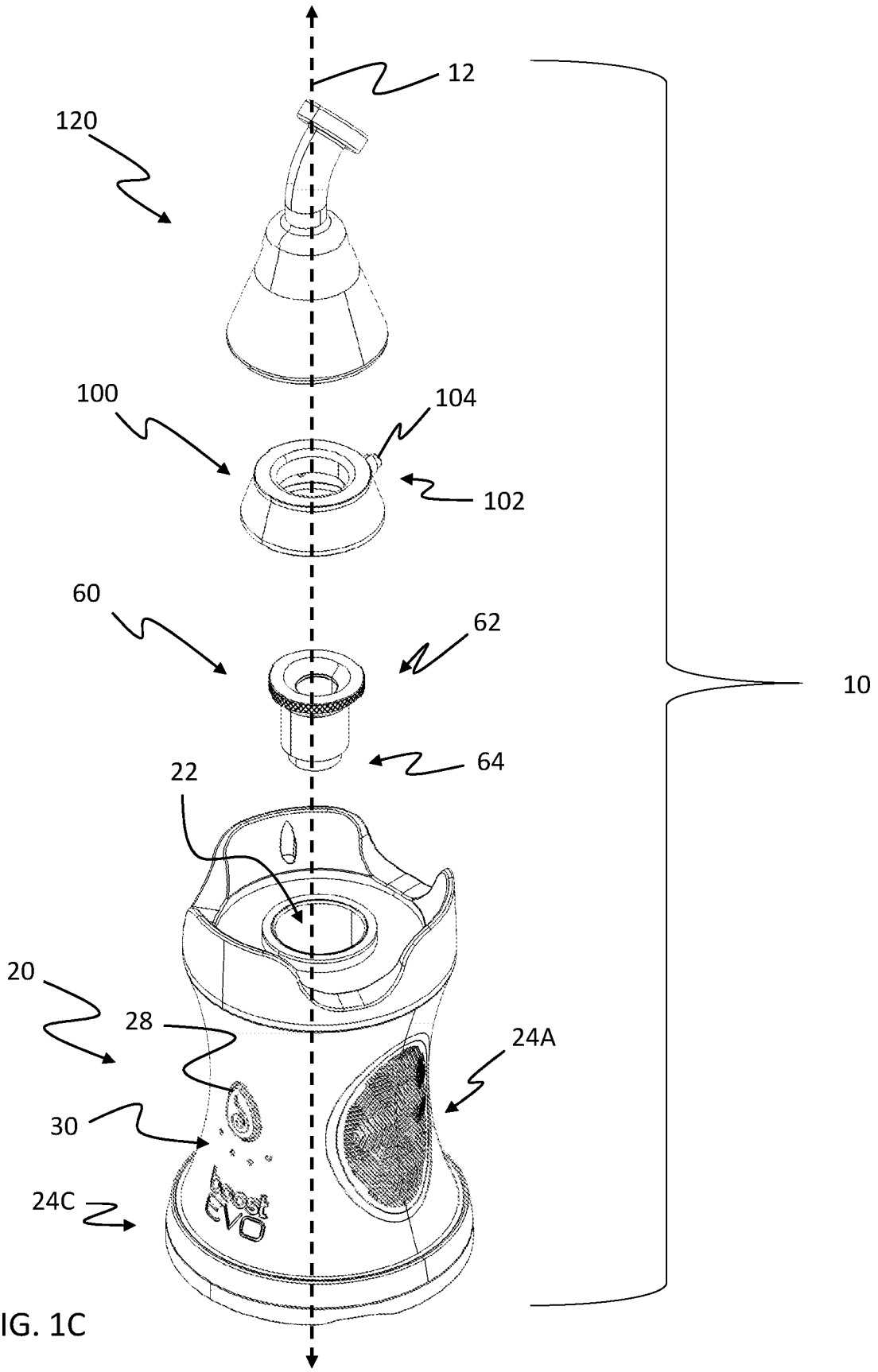
FIG. 1C is an exploded view of the electronic vaporizer of FIG. 1A.

With reference to the FIGS. and in operation, the present invention an provides electronic vaporizer 10 that is configured to aerosol an organic material and to provide the resultant vapor to a user to inhale. The organic material may include, but are not limited to, organic liquids and/or wax-like materials that are derived naturally or artificially made. As shown in FIGS. 1A-1C, in one embodiment the electronic vaporizer 10 includes a main unit 20, an atomizer 60, a quick connect adapter 100 and a mouthpiece 120. In the illustrated embodiment, the electronic vaporizer 10 has a central axis 12. The main unit 20, atomizer 60, quick connect adapter 100 and mouthpiece 120 are aligned and generally centered (along with many of the components thereof).

The main unit 20 include the control electronics and user interface/controls necessary to operate the electronic vaporizer 10 and to provide power to the atomizer 60 (see below). The atomizer 60 houses a heating crucible 62 in which the organic material is inserted or loaded and a heating element which converts electrical energy into thermal energy and applies the thermal energy to the material (see below). The quick connect (QC) adapter 100 removably couples the mouthpiece 120 to the main unit 20 (see below). The mouthpiece 120 collects exhausted vapor from the atomizer 60 and delivers the vapor to the user through the user's inhalation.

In the illustrated embodiment, the main unit 20 is a hand-held device that controls the electronic functions of the electronic vaporizer 10. The main unit 20 further acts as the hub that locks in the atomizer 60 and the QC adapter 100. As will discussed in further detail below, the main unit 20 includes a well 22 that is configured to receive the atomizer 60. The atomizer 60 is removable from the well 22. The well 22 is configured to make electrical connections between the atomizer 60 and the circuitry in the main unit 20 (see below). As will be explained in further detail below, in one embodiment the well 22 may include three pop-up pins or electrodes (such as POGO pins) to connect the circuitry of the main unit 20 with the atomizer 60. The main unit 20 may include one or more lighting features that illuminate to indicate the functionality of the electronic vaporizer 10 or to provide decorative lighting. In the illustrative embodiment, the main unit 20 includes three LED bands, i.e., two side panel LED bands 24A, 24B, and a base LED band 24C. The main unit 20 may also contain a charging port 26A, e.g., a USB-C charging port. In the illustrated embodiment, a USB port cover 26B is provided to protect the port 26A from dust and moisture.

The main unit 20 houses the primary electronics of the device. In the illustrated embodiment, the main unit 20 includes a primary printed circuit board (PCB) that controls the functionality of the electronic vaporizer 10 and three LED PCBs the control the LED bands to illuminate the side panels and the base of the device. The main unit 20 further includes a charging PCB that contains the USB-C receptacle 26A that is used to charge the electronic vaporizer 10 and a power cell battery that provides power to the electronic vaporizer 10. The primary PCB may also contain a switch 28, e.g., a push-button tactile switch that, in the illustrated embodiment, provide the only interface between the electronic vaporizer 10 and the user. The primary PCB also contains a plurality, e.g., four, of indicators 30, e.g., light emitting diodes (LED) which indicate the battery life of the electronic vaporizer 10.

The atomizer 60 houses the heating crucible 62, a heating element 64, and the electrical connections of the heating element 64. As will be discussed in further detail below, the heating element 64 includes two circuits or coils embedded therein. One of the circuits acts as a heating coil that converts electrical energy provided by the main unit 20 into thermal energy. The other circuit or coil acts as a temperature sensor, such as a thermistor. In the illustrated embodiment, the main unit 20 measures the resistance of the coil to determine the temperature of the heating element 64. The heating element 64 transfers the heat produced by the heating coil to the heating crucible 62. The heating crucible 62 holds the material that is to be vaporized.

In some embodiments of the electronic vaporizer 10, the heating element 62 converts electrical power to thermal energy through joule heating by directly heating the organic material or through thermally conduction via a material in direct contact with the organic material is in direct contact. The heating element 62 may vary in shape and size to fit the specific need of the electronic vaporizer. The electronic vaporizer 10 may include a single ceramic heating element, multiple ceramic heating elements, or multiple ceramic heating elements alongside other types of heating systems, such as induction heating, coil-based heating elements, or convective heating elements. In the illustrated embodiment, a single heating crucible 62 and a single heating element 64 are used.

Generally, the heating crucible 62 is typically made of a non-reactive material such as a quartz glass or high temperature ceramic to preserve the flavor of the produced vapor. Further, such materials resist corrosion and do not chemically react with the material loaded therein.

As will be discussed in more detail below, the atomizer 60 is housed within a steel body, and at the base has several electrode pads that connect to the pop-up pins or electrodes of the main unit 20. The atomizer 60 within the well 22 of the main unit 20 and held in place by a magnetic connection (see below).

The QC adapter 100 acts as an air intake manifold and as a receptacle to secure the mouthpiece 120. The QC adapted 100 may include an airflow valve 102 that regulates airflow. In the illustrated embodiment, the airflow valve 102 is a spring-loaded valve that in the uncompressed position only allows a limited amount of airflow. The airflow valve 102 may include a button 102A connected to the valve compresses the spring when pressed resulting in increased airflow. When the button 102A is pressed inward and the spring compressed, airflow is increased. The QC adapter 100 affixes to the main unit 20 by a magnetic connection.

The mouthpiece 120 is removably coupled to the QC adapter 100. In the illustrated embodiment, the QC adapter 100 includes a quick connect seal 104 that allows the mouthpiece to easily and quickly by removed and inserted within the QC adapter 100.

In general, the mouthpiece 120 allows the user to inhale creating low pressure within the mouthpiece and to transfer the low pressure to the atomizer 60 via the QC adapter 100. The mouthpiece 120 may be made of glass or other suitable material. The mouthpiece 120 may be configured to hold water in a reservoir so that the vapor goes through percolation. The percolation reduces the temperature of the vapor and assists in filtering out any unwanted residue in the vapor.

With reference to FIGS. 2A-2B, 3A-3B, 4 and 5, an exemplary main unit 20 shown. With specific reference to FIG. 2A, a functional block diagram of an electronic vaporizer 10 according to an embodiment of the present invention is shown. As discussed above, the electronic vaporizer 10 may include a main unit 20, an atomizer 60, a quick connect adapter 100 and a mouthpiece 120.

Figure 2A:
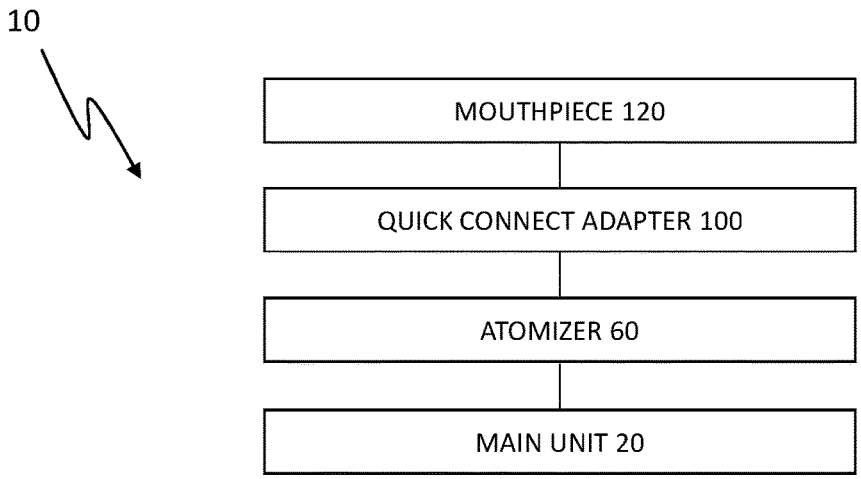
FIG. 2A is a functional block diagram of the electronic vaporizer of FIG. 1A, according to an embodiment of the present invention.
Figure 2B:
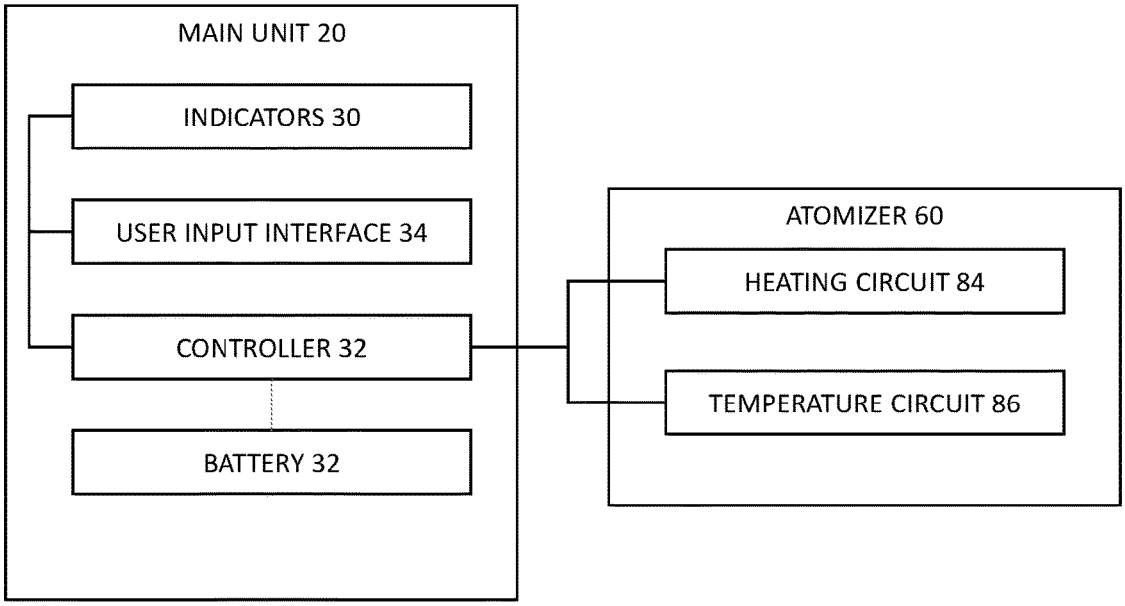
FIG. 2B is a functional block diagram of a control unit of the electronic vaporizer of FIG. 1A.
Figure 3A:
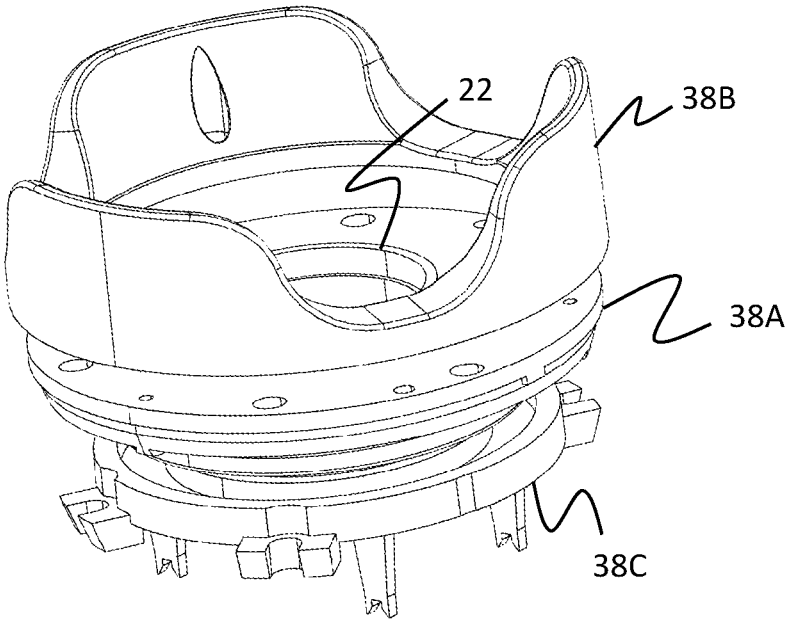
FIG. 3A is an exploded view of a first portion of the main unit of FIG. 1A.
Figure 3B:
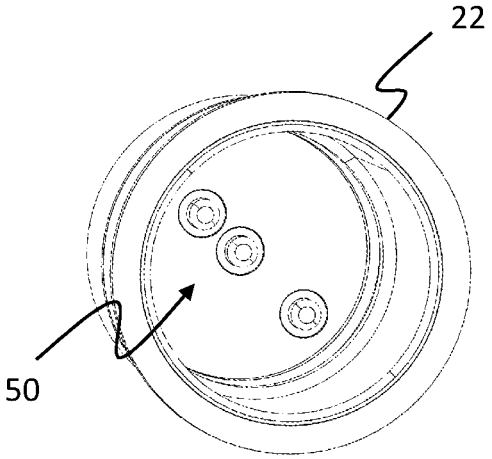
FIG. 3B is a perspective view of a well of the main unit of the electronic vaporizer of FIG. 1A.
Figure 4:
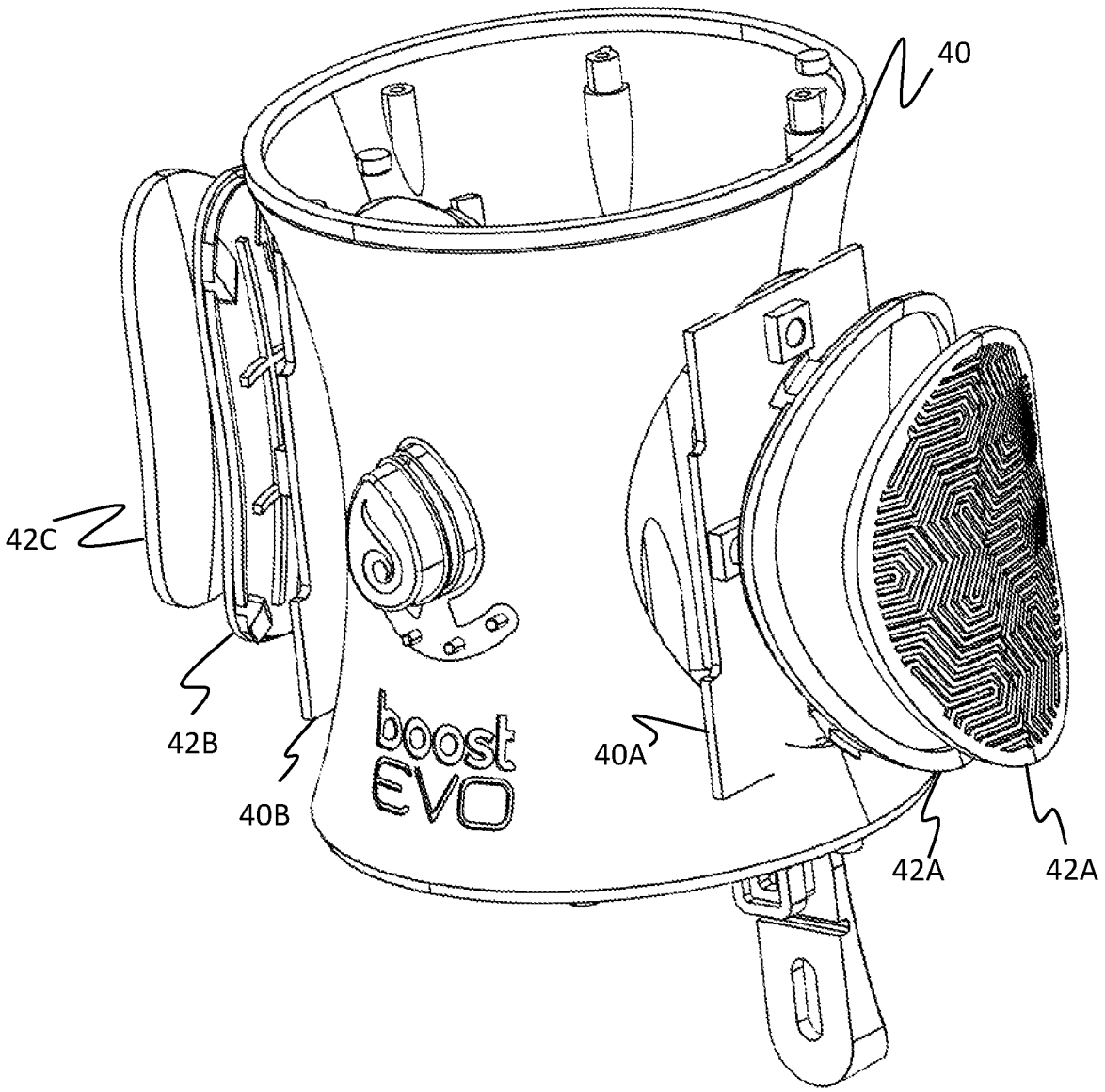
FIG. 4 is an exploded view of a second portion of the main unit of FIG. 1A.
Figure 5:
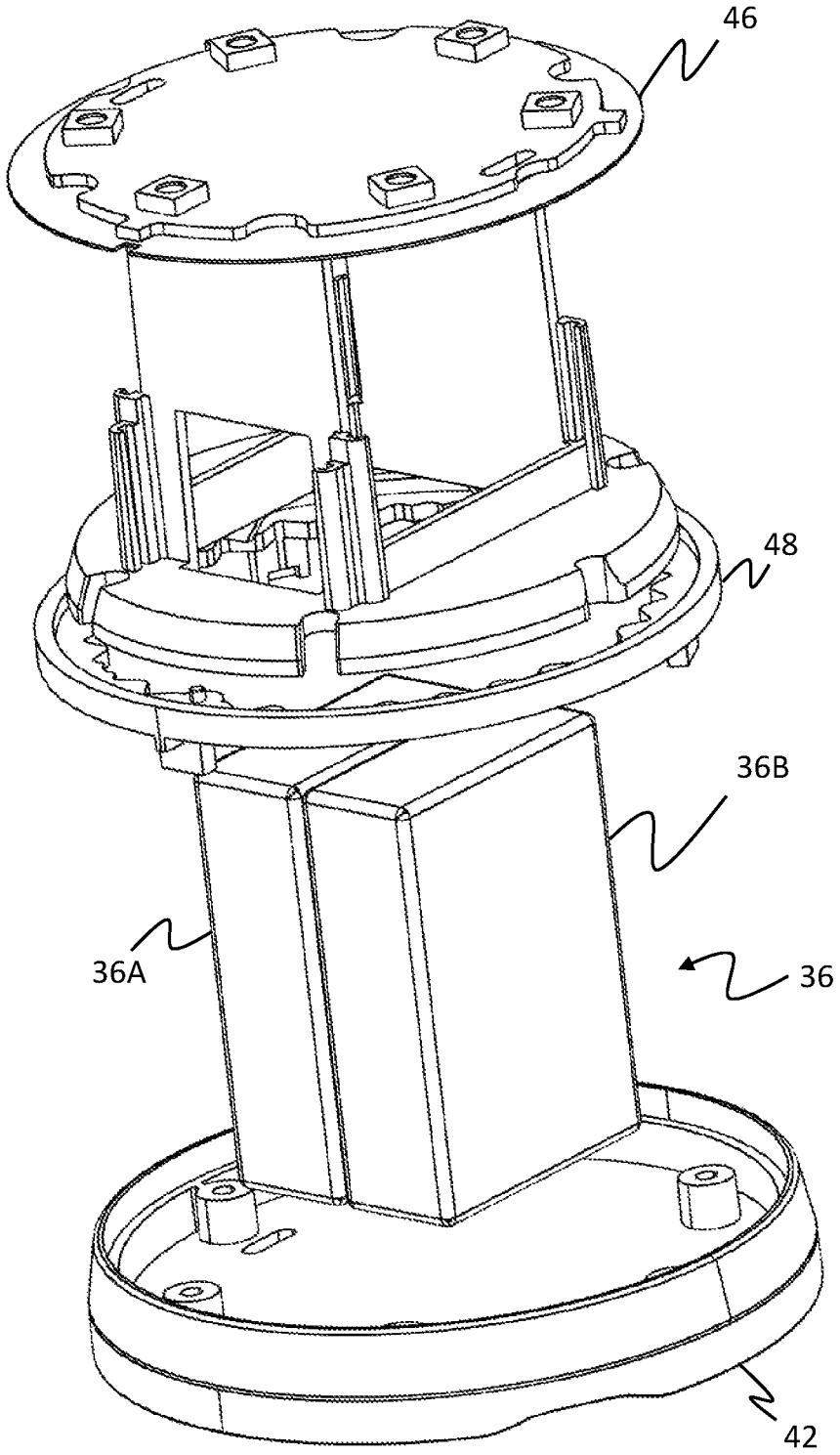
FIG. 5 is an exploded view of a third portion of the main unit of FIG. 1A.

With specific reference to FIG. 2B, the main unit 20 includes one or more indicators 30 to provide information and/or feedback to the user, a user input interface 32, a controller 34 and a battery 36. The battery 36 may be a lithium ion cell, a capacitor or other suitable energy storage device. The user input interface 32 allows the user to operate the electronic vaporizer 10. In the illustrated embodiment, the indicators 30 includes the LED bands 24A, 24B, 24C and the user input interface 32 includes the switch 28. Although a single switch 28 is shown in the illustrated embodiment, in other embodiments, the user input interface 32 may include additional switch and controls. In general, the user can control the electronic vaporizer by utilizing the user input interface 32 to adjust the settings. Alternatively, or in addition, the settings of the electronic vaporizer may be adjusted remotely through a wired or wireless connection, using a user device, such as cell phone or computer.

As discussed above, the atomizer 60 includes a heating element 64. As will be discussed in more detail below, the heating element 64 includes a heating circuit 84 and a temperature circuit or temperature sensing circuit 86. In operation, the user may operate the main unit 20 to heat material that has been placed in the heating crucible 62 to create vapor. The controller 34 in response to user operation of the user input interface 32 senses the temperature of the heating element 64 using the temperature sensing circuit 86 and responsively applies electrical current to the heating circuit 84. In one embodiment, the controller 34 measures the resistance of the temperature sensing circuit 86. The battery 36 supplies the current to the heating circuit 84 as well as powers the electronics.

The controller 34 provides the control logic to operate the main unit 20 and may include a microprocessor, programmable logic controller, an application specific logic controller, a custom controller or other suitable controller.

With reference to FIGS. 3A-3B and 4-5, several exploded views of an exemplary main unit 20 are shown. The well 22 is located within an upper shell 38A. As shown, in FIG. 3B, a plurality of pop-up electrodes 50 or POGO electrodes are located at the bottom of the well 22. A crown shell 38B surrounds the upper shell 38A and extends above the upper edge of the well 22. The upper shell 38A and the crown shell 38B are supported by an upper chassis 38C. A magnet ring (not shown) is positioned below the upper shell 38A. The magnet ring holds the atomizer 60 and the quick connect adapter 100 in place while allowing the user to controllably remove and replace atomizer 80 and the quick connect adapter 100 from the main unit 20.

The upper chassis 38C clips to a main shell 40. Within the main shell 40 are located two side panel printed circuit boards 40A, 40B which support respective side panel supports 42A, 42B and textured side panels 44A, 44B and the primary printed circuit board (not shown). A base shell 42 supports the battery 36, a base LED printed circuit board 46 and a base LED transmitter 48. The battery 36 in the illustrated embodiment includes two lithium ion batteries, 36A, 36B, as shown.

Figure 6:
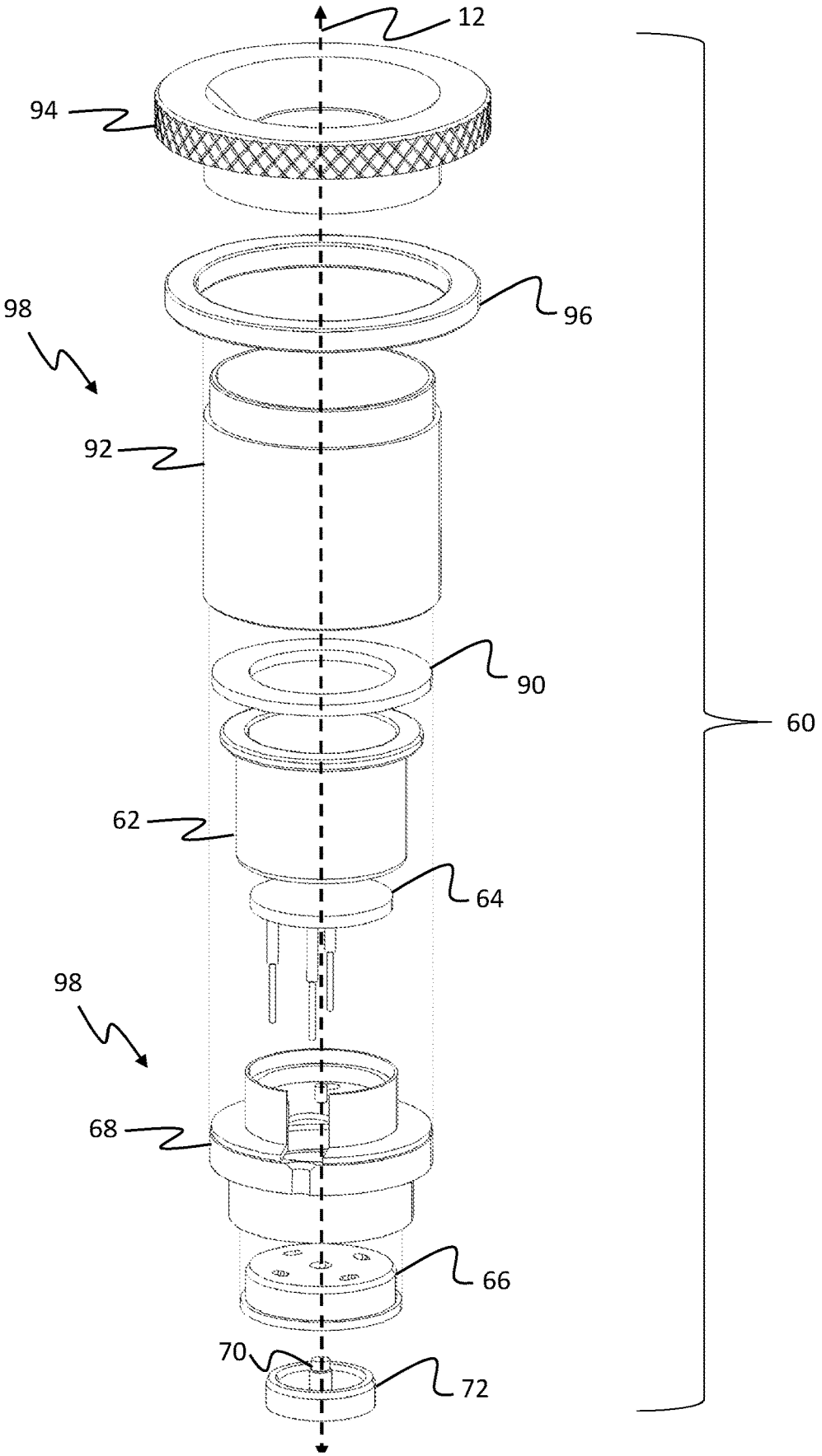
FIG. 6 is an exploded view of an exemplary atomizer for use in an electronic vaporizer.
Figure 7A:
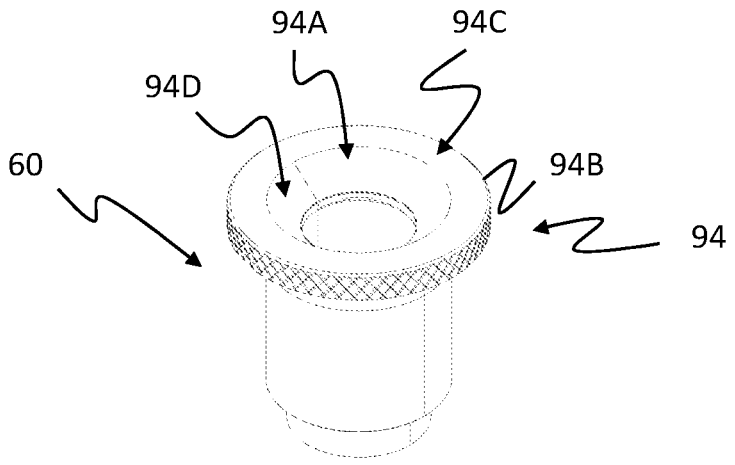
FIG. 7A is a perspective view of the atomizer of FIG. 6.
Figure 7B:
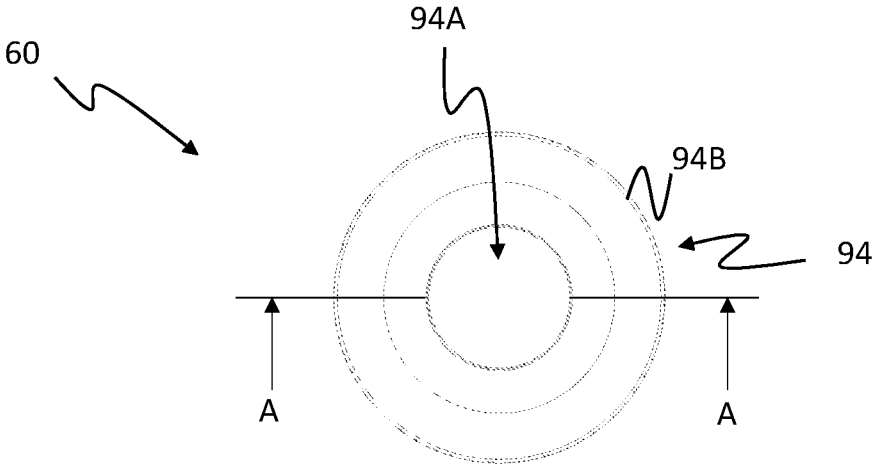
FIG. 7B is a top view of the atomizer of FIG. 6.
Figure 7C:
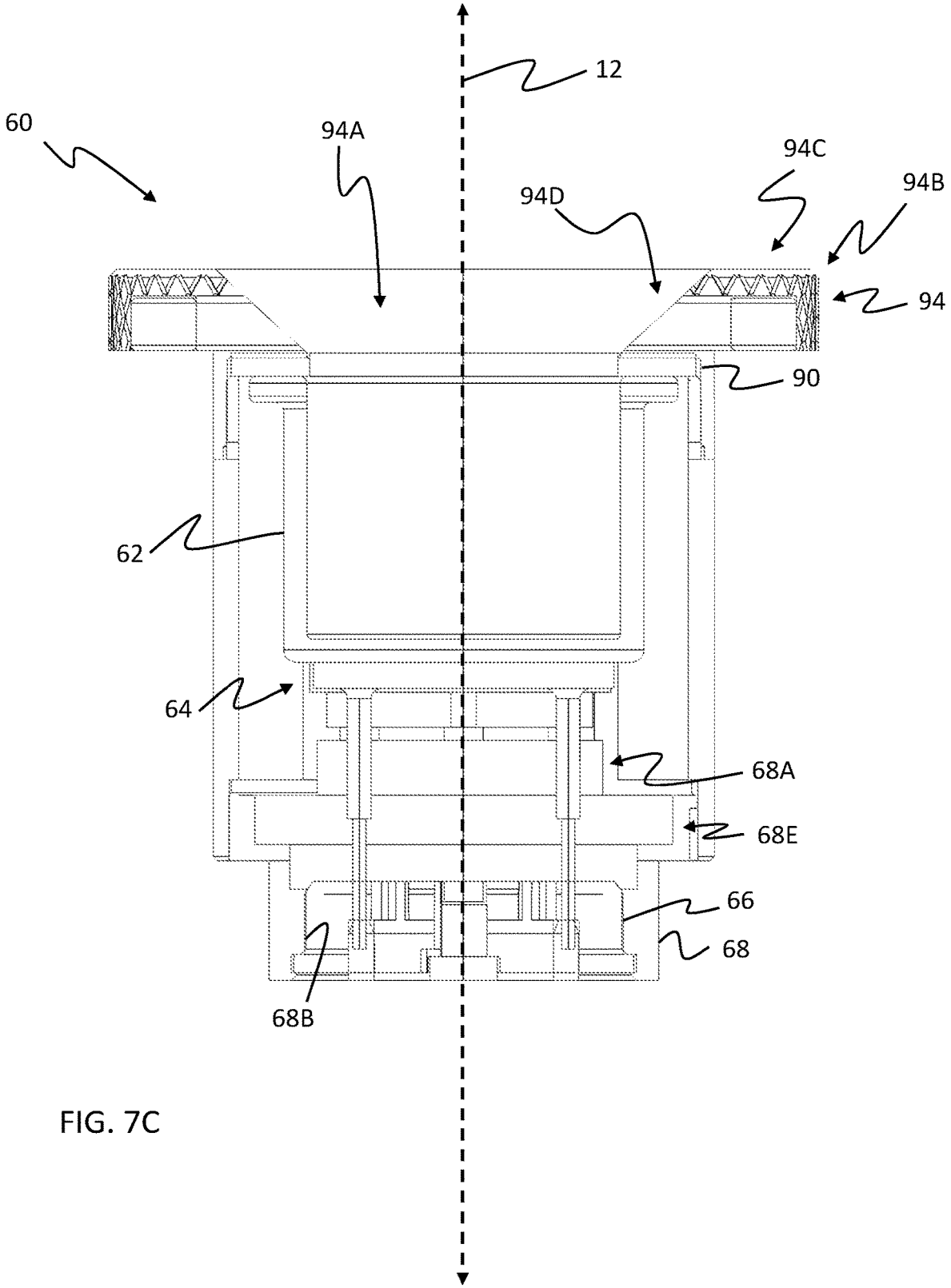
FIG. 7C is a cross-sectional view of the atomizer of FIG. 6.

With reference to FIGS. 6, 7A-7C, 8A-8D and 9A-9F, an exemplary atomizer 60 according to an embodiment of the present invention is shown. As shown in FIG. 6, the atomizer 60 includes an atomizer base housing or base housing 66 and an atomizer base or base 68. The base housing 66 receives a center electrode 70 and a ring electrode 72 in a center electrode receptacle 74 and a ring electrode receptacle 76, respectively. In one embodiment, the center and ring electrodes 70, 72 are press-fit into the respective receptacles 74, 76. In other embodiments, the center and ring electrodes 70, 72 may be retained within the receptacles 74, 76, by any suitable means, such as, an adhesive or, fasteners (screws, clips, etc. . . . ).

The base housing 66 may be composed from a high temperature plastic. In the illustrated embodiment, the base housing 66 is composed from Polytetrafluoroethylene (PTFE), however, it should be noted that any suitable material may be used.

The base 68 may be composed from a metal, such as stainless steel. In the illustrated embodiment, the base 68 is composed from SUS303 stainless steel, however, it should be noted that any suitable material may be used. The center electrode 70 and the ring electrode 72 may be made from any suitable conductive material, such as brass. In the illustrated embodiment, the center electrode 70 and the ring electrode 72 are composed from H78 brass.

The base 68 includes an opening 78 for receiving the base housing 66. In the illustrated embodiment, the base housing 68 is press fit into the opening 78 within the base 66. The base 66 includes a plurality of apertures 80 through which the center electrode 70 and the ring electrode 72 are accessible (see below).

With specific reference to FIGS. 6, 7 8A-8D, in one embodiment of the present invention the heating element 64 includes a heating element base 82, a heating circuit 84 and a temperature sensing circuit 86. In one aspect of the present invention, the heating circuit 84 and the temperature sensing circuit 86 are embedded within, or encapsulated by, the heating element base 82. In the illustrated embodiment, the heating circuit 84 and the temperature sensing circuit 86 have a coil-like shape. The heating element base 82 may composed from an electrically non-conductive, that is at least moderately thermally conductive, such as a ceramic.

In the illustrated embodiment, the heating element base 82 is composed from an alumina ceramic. However, the heating element base 82 may be composed from, or include, any suitable ceramic material or combination thereof, including but not limited to alumina oxide ceramic, alumina nitride ceramic, zirconia carbide ceramic, tungsten carbide ceramic, and silicon nitride, etc. Alternatively, the heating element base 82 may be composed from a high temperature resistance non-ceramic material or combination thereof, including but not limited to silicon dioxide, high temperature resistance composites, and high temperature resistance polymers. The heating element 82 must be able to transfer heat to the crucible 62, but in general most materials that have high thermal conductivity, e.g., metals, also have high electrical conductivity (metals). Ceramic materials are generally electrically insulating and have at least moderate thermal conductivity. A material with less than moderate thermal conductivity would take a significant time to heat and would require considerably more power.

Further, in the illustrated element, the heating circuit 84 and the temperature sensing circuit 86 are composed from a slurry of metal particles printed on a surface of the heating element base 82. The slurry is then sintered to form the circuit (or solid wires). The heating element base 82 is then re-sintered with additional alumina ceramic to encapsulate the circuits 84, 86. The present invention is not limited to the process recited above. Other suitable methods of creating the heating element 64 may also be utilized. Alternatively, the heating circuit 84 and the temperature sensing circuit 86 may include preformed wires embedded in the heating element base 82.

The heating circuit 84 acts as a heating wire by converting electric energy into heat. The heating circuit 82 may be printed into the heating element 64, or be an embedded wire and may be composed of materials such as but not limited to: nichrome alloy, tungsten alloy, etc. . . . . The temperature sensing circuit 86 may be a thermistor or a thermocouple. The thermistor can be composed of materials such as but not limited to: nichrome alloy, tungsten alloy, etc. . . . . A thermocouple type temperature sensor would be composed of two dissimilar metal filaments that are welded together at a junction. The two dissimilar metal filaments can be composed of materials such as but not limited to: nickel-chromium, nickel-alumel, iron, constantan, nicrosil, nisil, etc. . . . .

In one aspect of the present invention, the heating circuit 84 and the temperature sensing circuit 86 are composed of the same or similar materials. However, it should be noted that the heating and temperature circuits 84, 86 may be made from different materials to accommodate the different requirements of the respective uses.

Figure 8A:
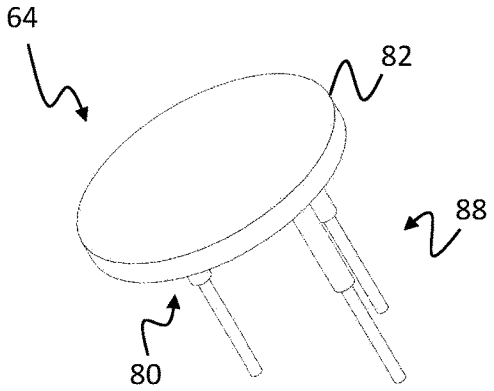
FIG. 8A is a perspective view of an exemplary heating element of the atomizer of FIG. 6.
Figure 8B:
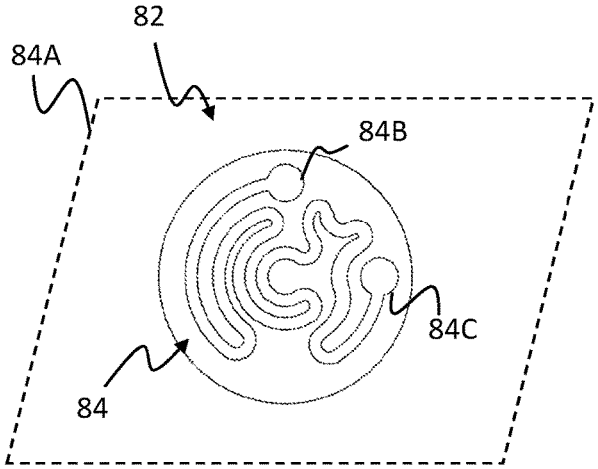
FIG. 8B is a cross-sectional view of a portion of the heating element of FIG. 8A.
Figure 8C:
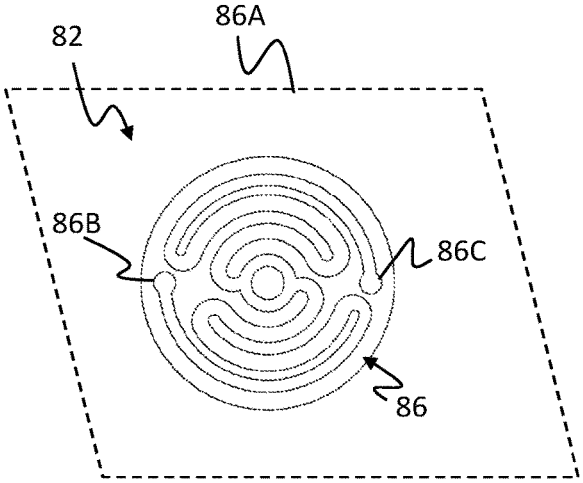
FIG. 8C is a cross-sectional view of another portion of the heating element of FIG. 8A.
Figure 8D:
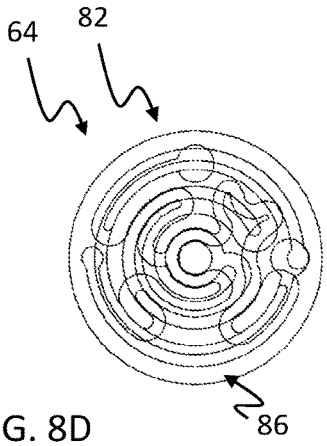
FIG. 8D is view of the heating element of FIG. 8A illustrating an overlay of a heating circuit and a temperature sensing circuit.

As shown in FIG. 8A, in the illustrated embodiment the heating element base 82 is disc shaped and has a first side 82A and a second side 82A. As shown in FIGS. 8B and 8C, the heating circuit 84 defines a first plane 84A and the temperature sensing circuit 86 defines a second plane 86B. In the illustrated embodiment, the first and second planes 84A, 86B are spaced apart a predefined distance are parallel. Further, the heating circuit 84 is closer to the first (or top) surface 82A than the temperature sensing circuit 86.

As shown in FIG. 8B, in the illustrated embodiment the heating circuit 84 includes two heating electrode connections 84B, 84C and the temperature sensing circuit 86 includes two temperature electrode connections 86B, 86C. The heating electrode connections 84B, 84C and the temperature electrode connections 86B, 86C are accessible through apertures (not shown) in the bottom side 82B of the heating element base 82. As shown in FIG. 8A, a plurality of wires 88 are located within the apertures to connect to the connections 84B, 84C, 86B, 86C.

In the illustrated embodiment, one of the heating electrode connections 84C and one of the temperature connections 86C overlap and serve as a common ground and thus a single wire is connected to both connections 84C, 86D. This results in a heating element 64 with three electrode connections and thus, three wires. However, in other embodiments, the heating element 64 may use separate grounds between the heating circuit 84 and the temperature sensing circuit 86 resulting in a heating element 64 with four electrode connections.

The arrangement of the heating circuit 84 and the temperature sensing circuit 86 inside the heating element 64 may be a function of: the shape and/or size of the heating element, uniformity of desired temperature, location where temperature is to be measured, and ability in manufacturing. In the illustrated embodiment, the heating circuit 84 and the temperature sensing circuit 86 are specifically designed where the heating circuit 84 is on an upper segment of the heating element 64, and the temperature sensing circuit 86 is on a lower segment of the heating element 64. The temperature sensing circuit 86 is generally designed to measure temperature uniformly across the heating element 64. The heating circuit 84 is designed for uniform heating as well.

In general, the electronic vaporizer 10 of the illustrated embodiment, utilizes the heating element 64 in the atomizer 60 to convert electric power into thermal energy and to measure the temperature of the heating element 64 passively through the temperature sensing circuit 86. The controller 34 and/or main unit 20 is electronically connected to the heating element 64 via connectors that may be controllably connected and disconnected, including, but not limited to press fittings, plugs, connection pins, pads, etc. . . . . The main unit 20 powers the heating element 64 to heat the atomizer 60 and to measure the temperature of the heating element 64 by measuring the resistance of the temperature sensing circuit 86.

The heating element 64 may be replaceable or be built in and non-serviceable. In other embodiments of the invention, the heating element 64 and the heating crucible 62 may be integrated into a single module which may be replaceable or may be integrated into the electronic vaporizer 10. In other embodiments, the atomizer 60 may also be external to the main vaporizer body or be built into the main vaporizer body.

The heating element base 82 has a predefined cross-section. The heating circuit 84 is configured to provide generally uniform heating across the cross-section of the heating element base 82. The temperature sensing circuit 86 is configured to measure temperature uniformly across the cross-section of the heating element base 82. In the illustrated embodiment the heating element base 82 has a circular cross-section. As shown in FIGS. 8B and 8C, the heating circuit 84 and the temperature sensing circuit 86 include a series of pathways comprised of a plurality of arcuate segments designed to adequately cover the entire cross-section of the heating element base 82.

In the illustrated embodiment, the base 68 includes an upper portion 68A having a receptacle 68B for receiving the heating element 82. The upper portion 68A of the base 68 includes an interior wall 68C located at the bottom of the receptacle 68B with a plurality of apertures 68C. Two of the wires 88 passes through one respective apertures 68C are connected to the center and ring electrodes 70, 72. The base 68 further includes a central platform 68D containing a slot 68E. A third one of the wires 88 is located within, and attached to the base 68 at, the slot 68E. The heating element 82 fits within the receptacle 68B with the second side 82B of the heating element base 82B facing the interior wall 68C of the base 68. The heating element 82 rests, and is centered within, the upper portion 68A of the base, by a ledge 68G located on an interior surface of the receptacle 68B.

The crucible 62 is positioned adjacent the first side 82A of the heating element 82. The crucible 62 includes a lip 62A and an interior cavity 62B and may be composed from a material such as glass. In other embodiments, the crucible 62 may be composed of a ceramic, composite, or metal material. The interior cavity 62B receives the material which is heated by the atomizer 62 to create vapor. In the illustrated embodiment, the crucible 62 is composed from quartz glass. A seal ring 90 may be located on an upper surface of the crucible 62 formed by the lip 62A. In one embodiment, the seal ring 90 may made from silicon.

The upper portion 68A of the base 68 and the crucible 62 fit within a metallic tube 92. A lower end of the tube 92 rests on a ledge 68H of the central platform 68E. The tube 92 extends past the ledge 68 and covers, and is electrically coupled to, the central platform 68E of the base 68.

The atomizer 60 further includes a cap 94. The cap 94 has a central aperture 94A which is open to the interior of the tube 92 and the interior cavity 62B of the crucible 62. The cap 94 includes an outer gripping portion 94B. In the illustrated embodiment, the outer gripping portion 94A is textured to provide a better gripping surface to facilitate removal of the atomizer 60 from the electronic vaporizer 10.

Figure 9A:
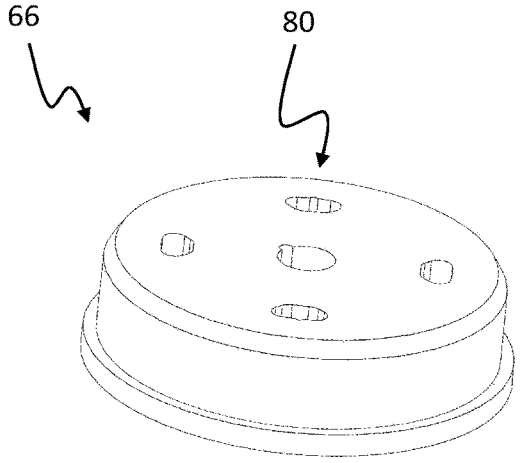
FIG. 9A is a perspective view of a base housing of the atomizer of FIG. 6, according to an embodiment of the present invention.
Figure 9B:
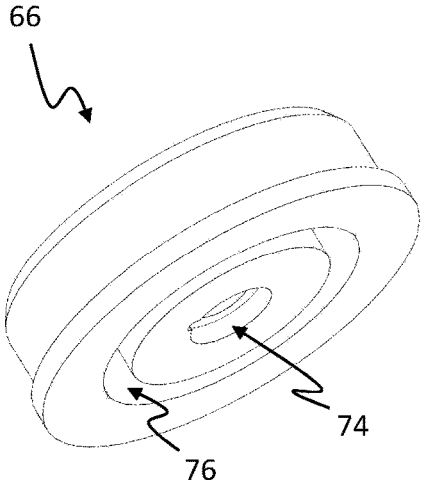
FIG. 9B is a second perspective view of the base housing of FIG. 9A.
Figure 9C:
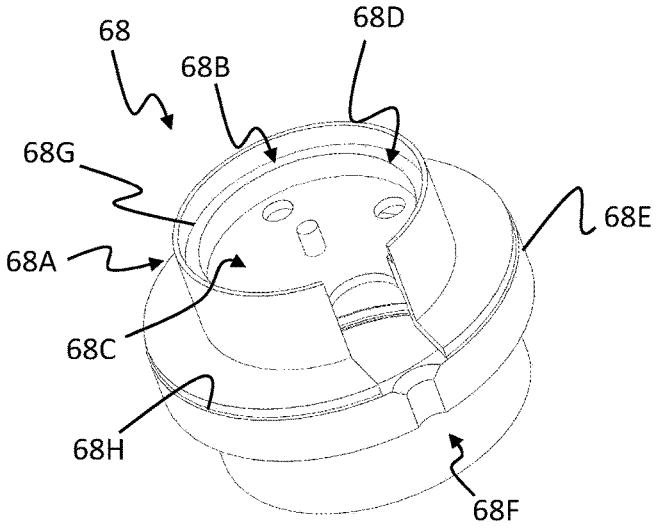
FIG. 9C is a perspective view of a base of the atomizer of FIG. 6, according to an embodiment of the present invention.
Figure 9D:
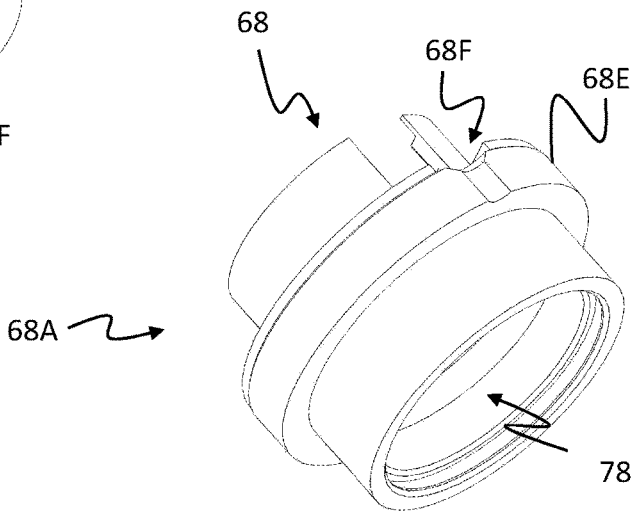
FIG. 9D is a second perspective view of the base of FIG. 9C.
Figure 9E:
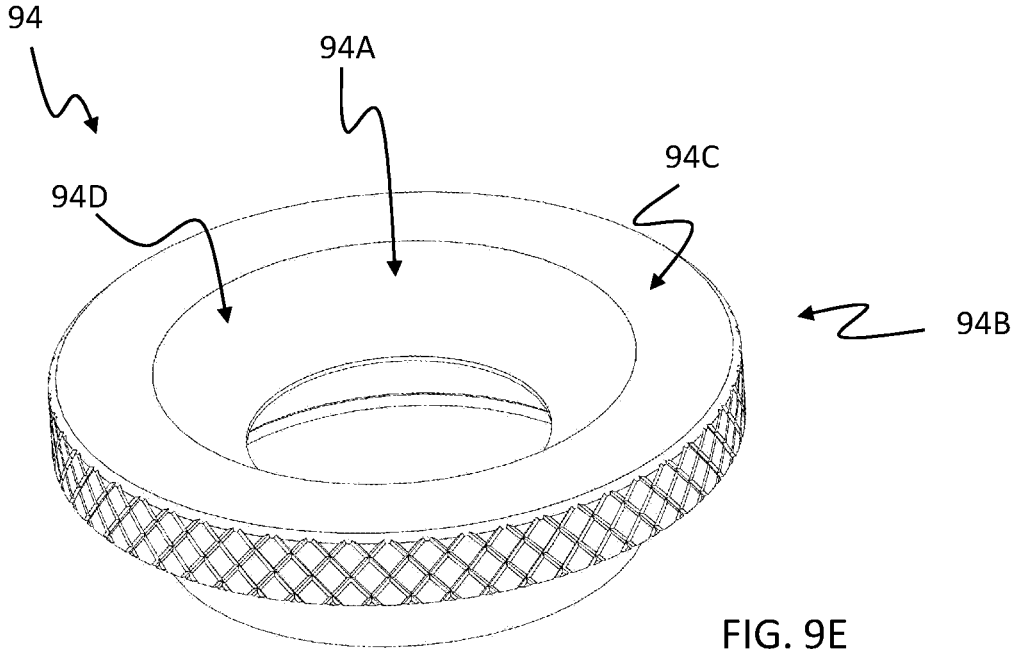
FIG. 9E is a perspective view of a cap of the atomizer of FIG. 6, according to an embodiment of the present invention.
Figure 9F:
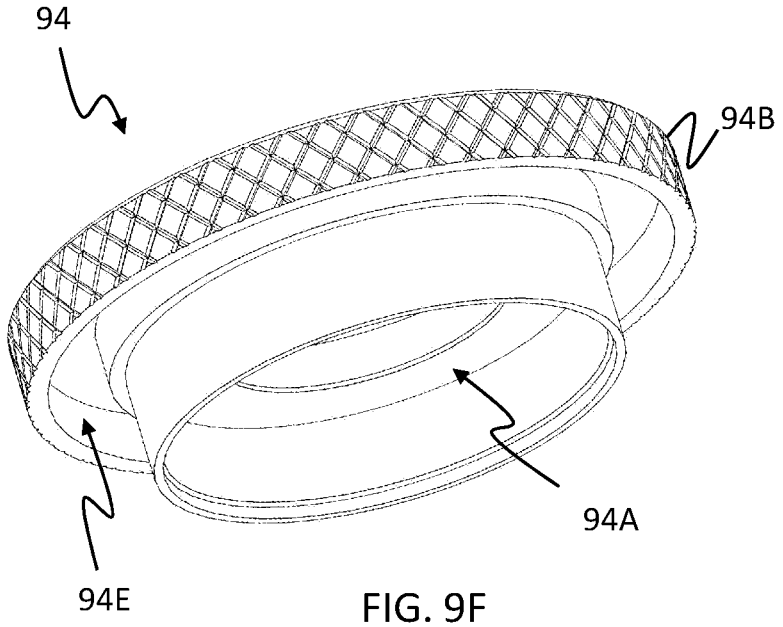
FIG. 9F is a second perspective view of the cap of FIG. 9E.

The cap 94 of the illustrated embodiment further includes a top surface 94C and a sloped surface 94D leading to the central aperture 94A. As shown in FIG. 9F, a ring-shaped receptacle 94E receives a ring-shaped magnet 96. The magnet 94 allows the atomizer 60 to be removably coupled to the main unit 20 (see below). In the illustrated embodiment, the magnet 94 is press-fit within the receptacle 94D.

In the illustrated embodiment, the cap 94 includes a lower tubular shaped portion which is press fit onto an upper portion of the tube 92.

In one embodiment, the center electrode 70 is used as ground and the ring electrode 72 is used as a temperature sensing electrode. A third electrode 98 may be coupled to the base 68. In the illustrated embodiment the base 68 and the tube 92 form the third electrode 98. The third electrode 98 may be used as a heating electrode. It should be noted that although the center electrode 70 is used as electrical ground, the ring electrode 72 is used as the temperature sensing electrode and the third electrode 98 is used as the heating electrode, the electrodes may be arranged or utilized differently.

The heating element 64 is electrically coupled to the heating electrode 68, 92 and the temperature sensing electrode 72 by the wires 88. The heating crucible 62 is thermally coupled to the heating element 82.

With reference to FIGS. 10A-10C and 11A-11G, an exemplary quick connect (QC) adapter 100 is shown. As discussed, above, the quick connect adapter 100 is adapted to use with an electronic vaporizer 10. The electronic vaporizer 10 has a main unit 20, an atomizer 60 removably coupled to the main unit 20 and a removable mouthpiece 120. In the illustrated embodiment, the quick connect adapter 100 includes a quick connect adapter housing 100A defining an inner channel 100B. The inner channel 100B has a first open end 100C and a second open end 100D and is centered on the center axis 12.

In generally, the quick connect adapter 100 assists the electronic vaporizer 10 to aerosol the volatile organic compounds of an organic substance or material that is loaded into the heating crucible 62 for the user to inhale the desired vapor. The desired organic substance or material may be either solid or liquid base and be natural or artificial in origin. The electronic vaporizer 10 may use a combination of heat and air pressure changes to aid in the phase-change of the volatile organic compounds in the organic substance to produce the vapor. As discussed above, the electronic vaporizer 10 includes a base electronic unit or main unit 20, an atomizer 60 and the quick-connect adapter 100. The electronic vaporizer 10 utilizes the main unit 20 to power the atomizer 60 which directly heats the organic substance to produce vapor. The quick-connect adapter 100 is added onto the main unit to aid in the vapor production by controlling the airflow into the atomizer 60 and aiding in the production of vapor. It should be noted that in electronic vaporizers 10 with the quick connect adapter 100, the atomizer 60 may utilize other types of heating elements 64. For instance, in other embodiments, the heating element 64 can use indirect heating, i.e., the crucible 64 may be hearing through either convection or induction heating.

In the illustrated embodiment, the quick connect adapter 100 includes a mouthpiece quick release connector 104 coupled to, and located adjacent, the first end 100C of the quick connect adapter housing 100A. The mouthpiece quick release connecter 104 is configured to allow the mouthpiece 120 to be releasably coupled to the main unit 20 via the quick connect adapter 100. In one embodiment, the mouthpiece quick release connecter 104 is a seal 106. The seal 106 may be composed from a flexible material, such as silicon. As discussed in further depth below, the quick connect adapter 100 defines an air flow path to allow vapor to flow from the atomizer 60 to the mouthpiece 120.

As discussed above, an air flow valve 102 is connected to the quick connect adapter housing 100A. The air flow valve 102 is coupled to the air flow path to regulate airflow therethrough. In the illustrated embodiment, the air flow valve 102 is a spring valve. However, the air flow valve 102 may be any suitable valve including, but not limited to a spring valve, a knob valve and an on/off plug valve.

An adapter connector 108 is coupled to, and located adjacent, the second end 100D of the quick connect adapter housing 100A. The adapter connector 108 is configured to allow the quick connect adapter 100 to be releasably coupled to the main unit 20. In the illustrated embodiment, the adapter connector 108 includes a magnet 110. However, it should be noted that the adapter connector 108 may be comprised of other types of connectors, for example, a physical connector, such as, but not limited to a clip.

Figure 10A:
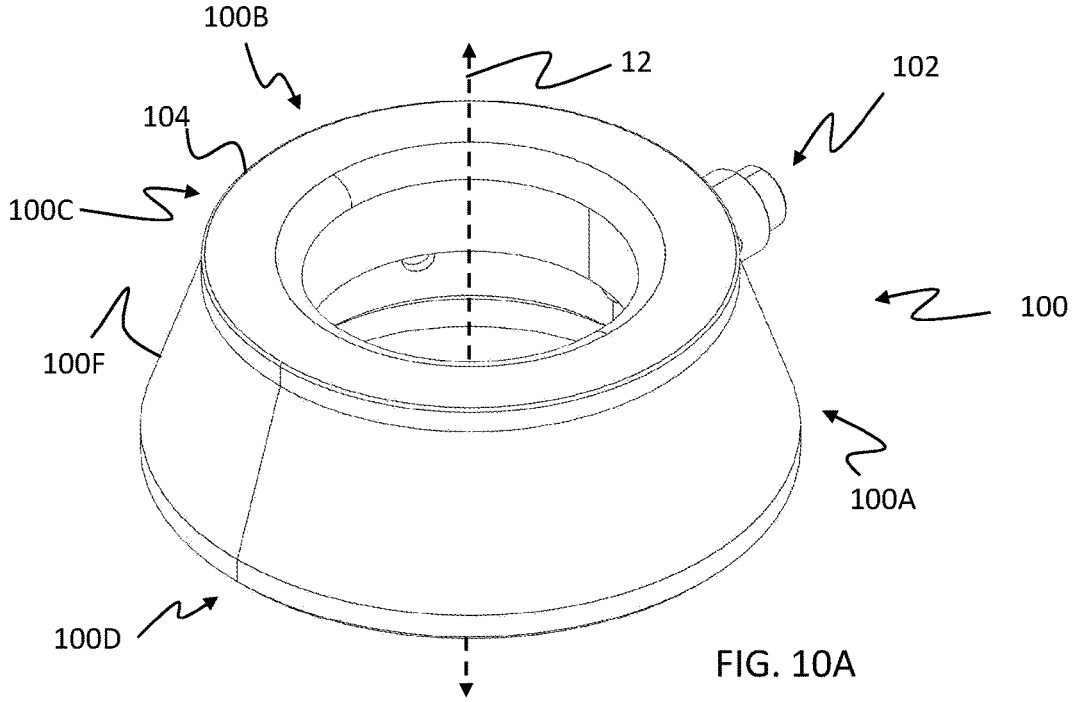
FIG. 10A is a perspective view of an exemplary quick connect adapter of the electronic vaporizer of FIG. 1A, according to an embodiment of the present invention.
Figure 10B:
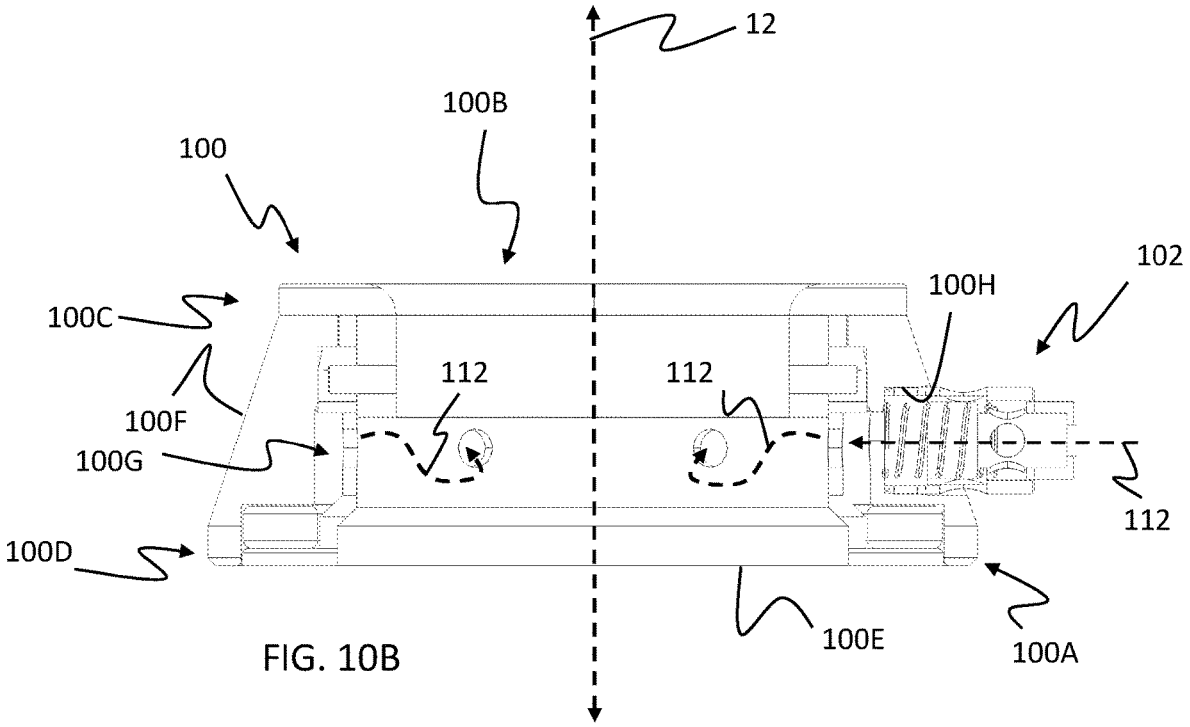
FIG. 10B is a cross-sectional view of the quick connect adapter of FIG. 10A.
Figure 10C:
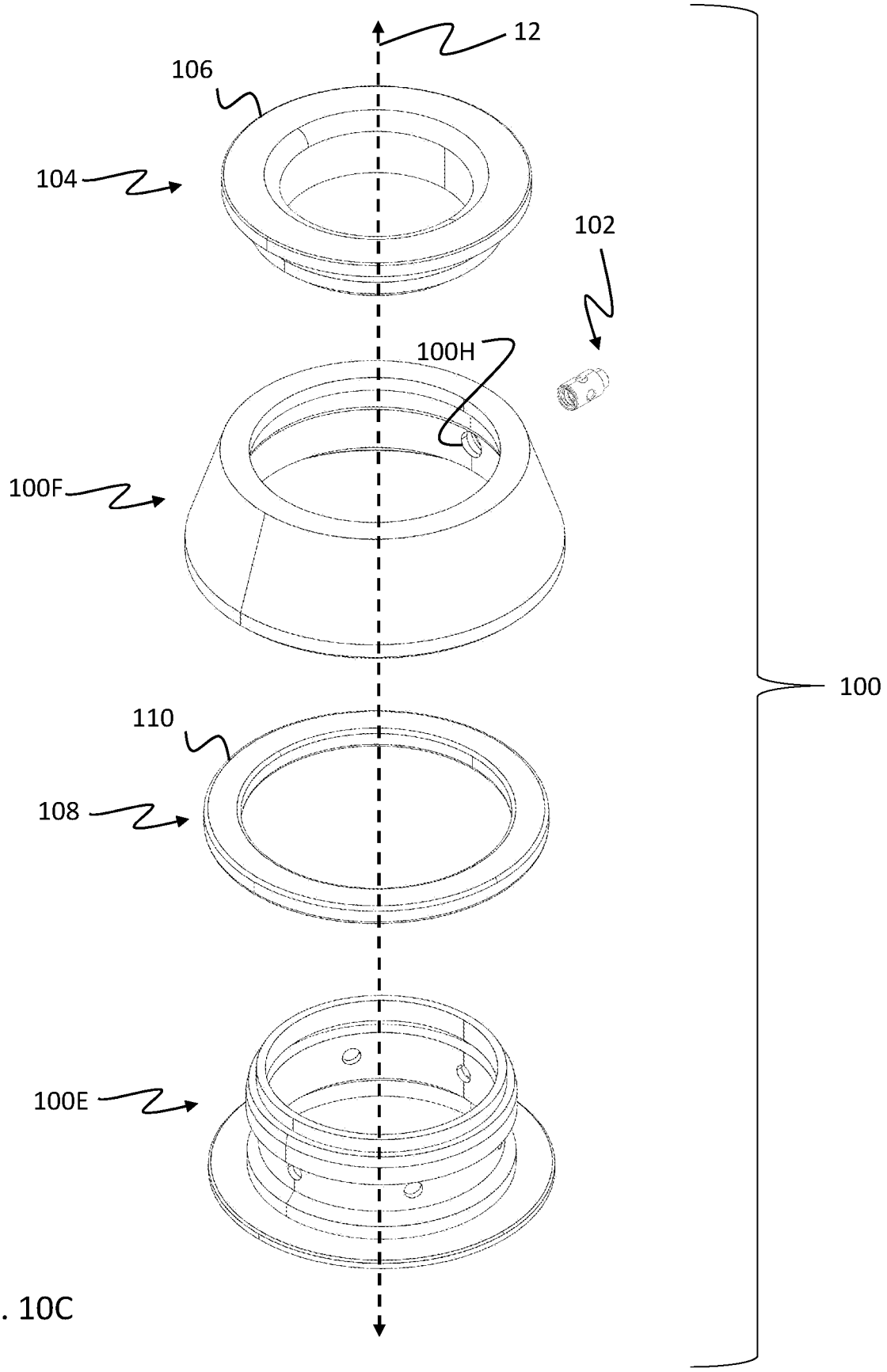
FIG. 10C is an exploded view of the quick connect adapter of FIG. 10A.
Figure 11A:
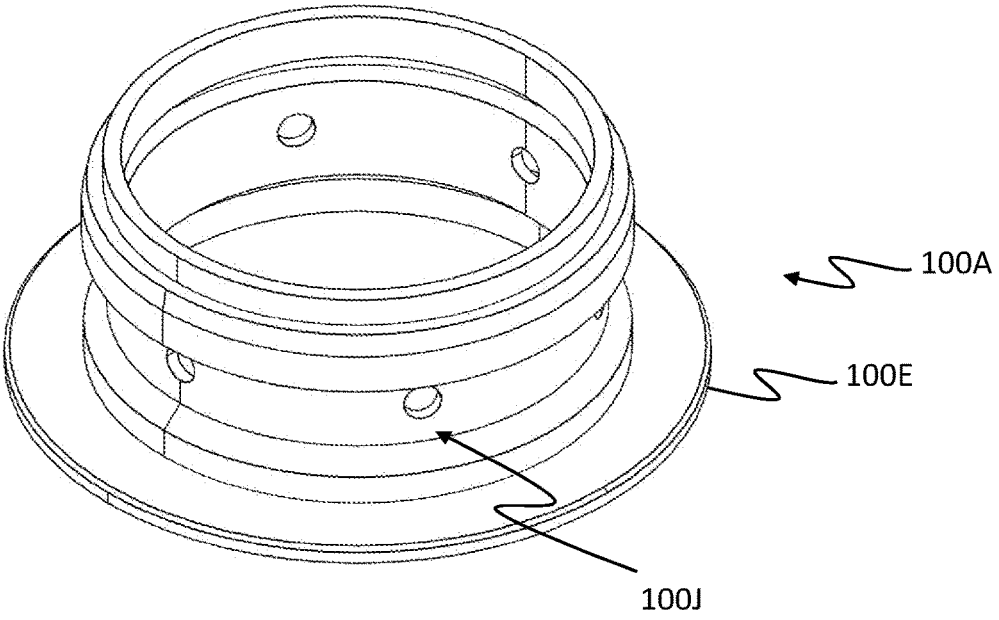
FIG. 11A is a perspective view of a quick connect base of the quick connect adapter of FIG. 10A.
Figure 11B:
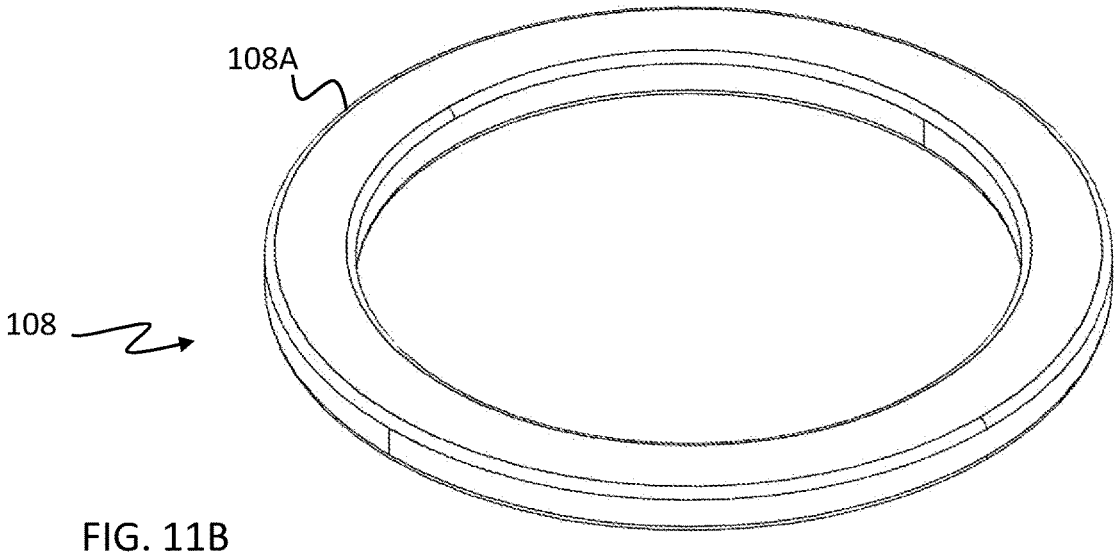
FIG. 11B is a perspective view of a ring magnet of the quick connect adapter of FIG. 10A.
Figure 11C:
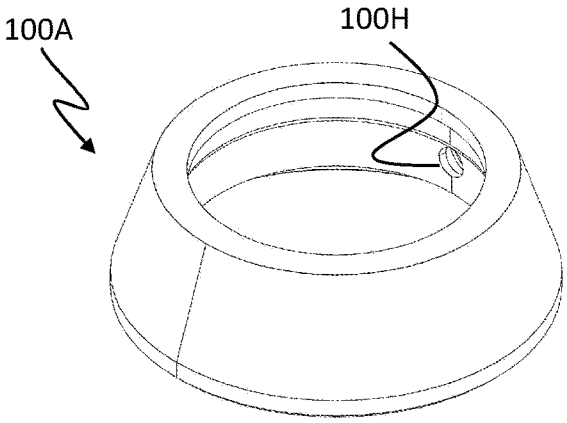
FIG. 11C is a perspective view of a body of the quick connect adapter of FIG. 10A.
Figure 11D:
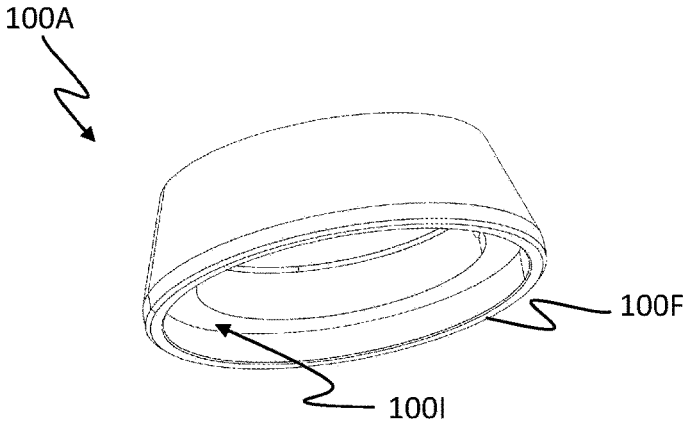
FIG. 11D is a second perspective view of a body of the quick connect adapter of FIG. 10A.
Figure 11E:
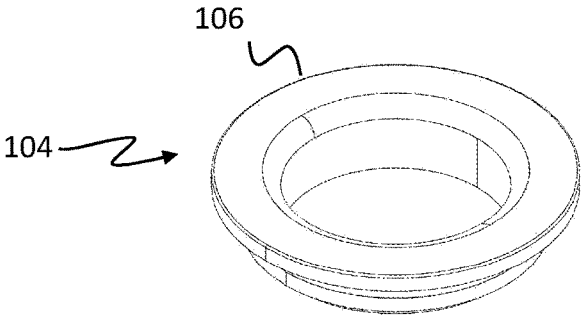
FIG. 11E is perspective view of a seal of the quick connect adapter of FIG. 10A.

With specific reference to FIGS. 10B, 11A and 11C, in one embodiment of the present invention, the quick connect adapter housing 100A includes an inner frame 100E and an outer body 100F. As shown in FIG. 10B, the inner frame 100E and the outer body 100F define an interior cavity 100G therebetween. The outer body 100F includes a valve aperture 100H for receiving the air flow valve 102. In the illustrated embodiment, the outer body 100F includes an inner ledge 100I (see FIG. 11D). The magnet 110 is located adjacent the inner ledge 100I and the inner frame 100E is press fit within the outer body 100F thereby retaining the magnet 110 therein. As shown in FIG. 11A, the inner frame 100E includes a plurality of inner apertures 100J. In one embodiment, the inner frame 100E and the outer body 100F are made from metal. In the illustrated embodiment, the inner frame 100E and the outer body 100F are made from stainless steel and aluminum, respectively.

Figure 11F:
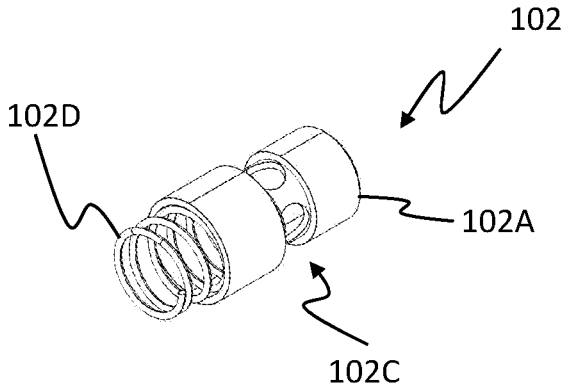
FIG. 11F is first perspective view of a portion of a valve of the quick connect adapter of FIG. 10A.
Figure 11G:
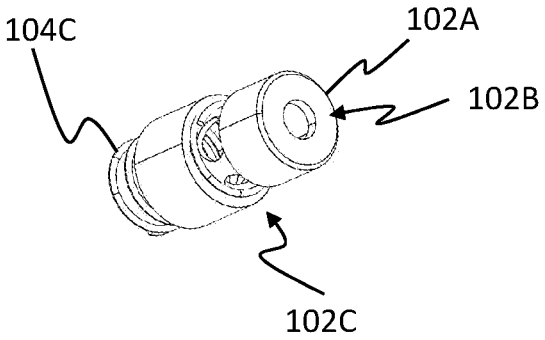
FIG. 11G is second perspective view of the portion of a valve of the quick connect adapter of FIG. 10A.
Figure 11H:
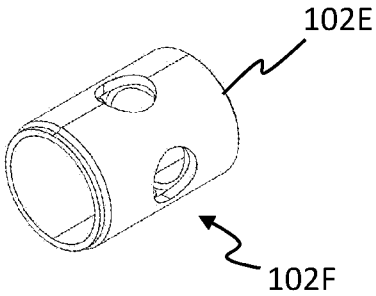
FIG. 11H is perspective view of a valve housing of the quick connect adapter of FIG. 10A.

With reference to FIGS. 11F-11H, as referenced above, in the illustrated embodiment, the air flow valve 102 is a spring valve and includes a push button 102A with a button primary air inlet 102B and a plurality of button secondary inlet inlets 102C. The air flow valve 102 further includes a spring 102D and a valve outer housing 102E. In the illustrated embodiment, the push button 102A is received within the valve outer housing 102E. The spring 102D acts against the push button 102A biasing the bush button 102A outward, i.e., away from the quick connect adapter housing 100A. In this position, the button secondary inlet inlets 102C are substantially blocked by the valve outer housing 102E. Thus, air will flow from outside the electronic vaporizer 10 into the interior cavity 100G of the quick connect adapter housing 100A through the button primary air inlet 102B. Air entering the interior cavity 100G will be limited by the geometry of the button air inlet 102B. In the illustrated embodiment, the push button 102A and the valve outer housing 102E are made from brass and the spring 102D is made from steel.

The air flow valve 102 may be used by the user to vary the amount of air allowed to enter the interior cavity 100G. For example, in the illustrated embodiment, a user may further restrict air flow into the interior cavity 100G by blocking the button primary air inlet 102B. The user may then allow air to enter the interior cavity 100G by discontinuing to block the button primary air inlet 102B. Alternatively, the user may press the push button 102A inward. This will result in aligning the button second air inlets 102C with the outer housing air inlets 102F, thereby allow air to enter the interior cavity 100G. The amount of air flowing into the interior cavity 100G will be a function of the geometry of the button second air inlets 102C with the outer housing air inlets 102F. In the illustrated embodiment, the amount of air flowing into the interior cavity 100G when the button second air inlets 102C and the outer housing air inlets 102F are aligned is greater than the amount of air flowing into the interior cavity 100G through the button primary air inlet 102B.

Returning to FIG. 10B, air flow through the quick connect adapter 100 is illustrated by arrows 112. As discussed above, air enters the interior cavity 100G of the quick connect adapter housing 100A and then flows into the inner channel 100B of the quick connect adapter 100 via the inner apertures 100J. As will discussed in further detail below, from inner channel 100B of the quick connect adapter 100, air flows down into the interior of the heating crucible 62 and then up through the mouthpiece 120.

Figure 12A:
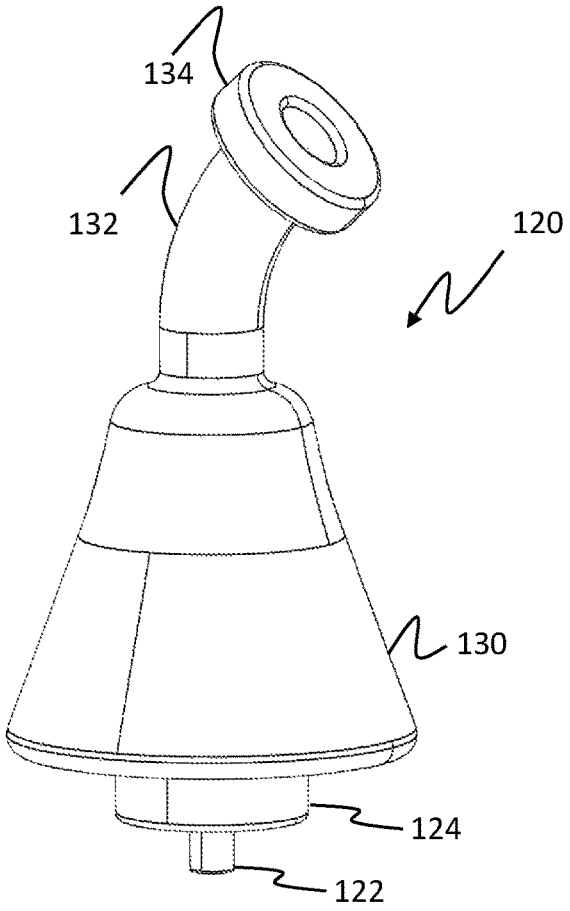
FIG. 12A is a perspective view of a mouthpiece for use with the electronic vaporizer of FIG. 1A, according to an embodiment of the present invention.
Figure 12B:
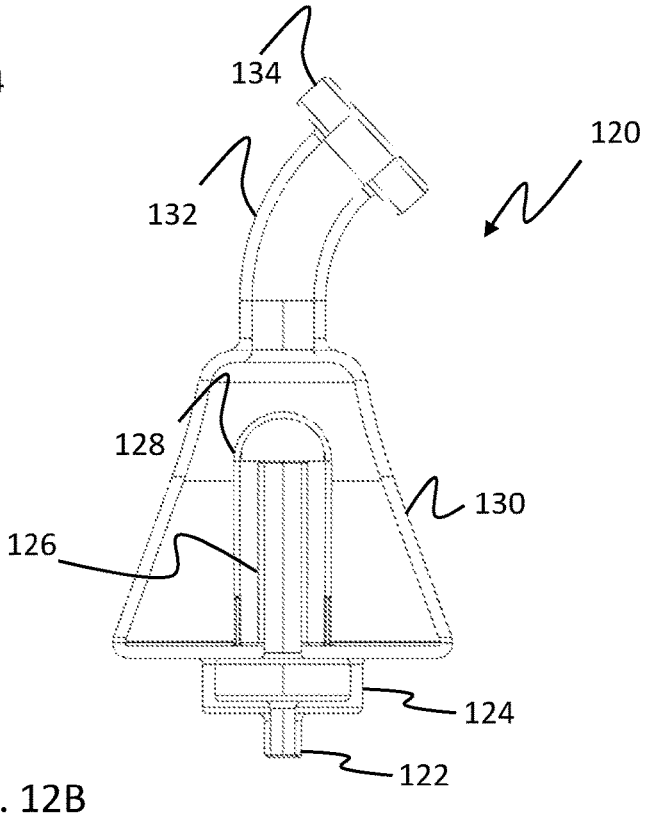
FIG. 12B is a cross-section view of the mouthpiece of the FIG. 12A.

With reference to FIGS. 12A and 12B, an exemplary mouthpiece 120 is shown. As discussed above, in general, the mouthpiece 120 allows the user to inhale creating low pressure within the mouthpiece 120 and to transfer the low pressure to the atomizer 60 via the quick connect adapter 100. In the illustrated embodiment, illustrated mouthpiece 120 is a percolating type mouthpiece and is made from glass. However, it should be noted that that the illustrated mouthpiece is illustrative only. Any type of mouthpiece, including a non-percolating mouthpiece, may be used without departing from the spirit of the invention. As further discussed above, the mouthpiece 120 is removably coupled to the main unit 20 of the electronic vaporizer 10 using the quick connect adapter 100.

In the illustrated embodiment, the mouthpiece 120 includes a stem 122 with an inner bore. The stem 122 is removably coupled to the quick connect adapter 100 via the mouthpiece quick release connector 104. In the illustrated embodiment, the mouthpiece quick release connector 102 is a flexible seal 106. The stem 122 is appropriately sized such that the mouthpiece 120 may be slid into and out the flexible seal 106.

Vapor from the heating material rises from the heating crucible 62 and enters the bore of the stem 122 and then passes through a moisture collector 124 and enters an inner tube 126. The inner tube 126 is concentric with an outer tube 128. Vapor rises through the inner tube 126 and is drawn down through the outer tube 128 and enters a reservoir 130 that is filled with water through apertures in the outer tube 128. The vapor percolates through the water to reduce the temperature of the vapor and to assist in filtering out any residue within the vapor. The vapor then rises through a neck 132. The neck 132 terminates in mouth engaging portion 134.

INDUSTRIAL APPLICABILITY

With reference to the drawings, and in operation, the present invention provides an electronic vaporizer 10 that includes a main unit 20, an atomizer 60, a quick connect adapter 100 and a mouthpiece 120.

The main unit 20 houses all electronics, the user interface, and controls the power delivered to the atomizer 60. The atomizer 60 houses the heating crucible 62 where material is loaded into, and the heating element 64 which converts electrical energy into thermal energy. The quick connect adapter 100 acts as the coupling between the mouthpiece 120 and the main unit 20 and controls airflow into the atomizer 60. The mouthpiece 120 collects the exhausted vapor produced from the atomizer 60 and delivers the vapor to the user as the user inhales.

The main unit 20, in the illustrated embodiment, is a hand-held device that controls the electronic functions of the electronic vaporizer 20, and acts as the hub that locks in the atomizer 60, along with the quick connect adapter 100.

The main unit 20 includes a well 22 that receives the atomizer 60 and makes the electrical connections with the circuitry of the main unit 20. In the illustrated embodiment, the well 22 has three pop-up connectors, e.g., three POGO electrodes that make the electrical connection to the atomizer 60.

In the illustrated embodiment, the main unit 20 includes three LED bands, e.g., two side panel LED bands and a base LED band, that illuminate to indicate specific functionality, as well as, for decorative purposes. The main unit 20 a USB-C charging port.

The main unit 20 houses the primary electronics of the electronic vaporizer 10. In the illustrated embodiment, the main unit 20 houses a primary printed circuit board (PCB) that controls the functionality of the electronic vaporizer 10, three LED PCB s which illuminate the side panels and the base of the device, a charging PCB which contains the USB-C Receptacle that is used to charge the electronic vaporizer 10, and a dual LiPo Power Cell which provides power to the device. The primary PCB also contains a basic push-button tactile switch (switch 28) which is the only interface the device has with the user. The primary PCB also contains four LEDs which indicate the battery life of the device.

The atomizer 60 houses the heating crucible 62, the heating element 64, and the electrical connections of the heating element 64. As discussed above, the heating element 64 may contain two circuits embedded therein. One of the circuits acts as a heating coil that converts electrical energy provided by the main unit into thermal energy. The other circuit acts as a thermistor. The main unit 20 measures the resistance of the coil to determine the temperature of the heating element 64. The heating element 64 transfers the heat produced by the heating coil to the heating crucible 62. The heating crucible 62 is a vessel that holds the material that is to be vaporized. The heating crucible 62 is typically made of a non-reactive material such as a quartz glass or a high temperature ceramic, a metal or a composite material to preserve the flavor of the produced vapor and to not corrode or chemically react with the material that is loaded into.

The atomizer 60 may be houses in a steel body and include several electrode pads that connect to the POGO electrodes of on the main unit 20. The atomizer 60 is placed inside, and removable from, the well 22 of the main unit 20. The atomizer 60 is held in place by a magnetic connection.

The quick connect adapter 100 acts as an air intake manifold and the receptacle to secure the mouthpiece 120. As discussed above, the quick connect adapter 100 includes an airflow valve 102 that regulates airflow. In the illustrated embodiment, the airflow valve 102 is a spring-loaded valve that in the un-compressed position only allows a limited amount of airflow, but when the spring is compressed when a button is pressed, the airflow is increased. The quick connect adapter 100 removable affixes to the main unit 20 by a magnetic connection.

The mouthpiece 120 presses into the silicone seal 106 of the quick connect adapter 100. The mouthpiece 120 may be a glass attachment for the user to inhale off and transfer the low pressure to the atomizer 60. The mouthpiece 120 may also contains, but does not require, water so that the vapor goes through percolation to reduce the temperature of the vapor and help in filtering out any unwanted residue in the vapor.

The electronic vaporizer 10 may be operated by the user by placing the atomizer 60 into the main unit 20. The user may then load the material to be vaporized into the heating crucible 62. Typically, the mouthpiece 120 will be attached to the quick connect adapter 100 using the silicone pressure seal 106 and these two components will be fixed together for easier operation. The quick connect adapter 100 and the mouthpiece 120 may then be placed on the main unit 20 and will enclose the atomizer 100. The user can then activate the main unit 20 by different combinations of activating the switch/button 28. The user has the ability to cycle between temperature settings, choose decorative lights to be illuminated, control heating time, and control heating of the atomizer 60 using the switch/button 28.

When the user activates a heating cycle, the main unit 20 measures the resistance of the temperature sensing circuit 86 or thermistor built into the heating element 64, while also delivering power to the heating circuit 84 built into the heating element 64. The main unit 20 adjusts power as the temperature begins to reach the set-point measured by the thermistor 86. Once the set-point temperature is reached, the main unit 20 will indicate this to the user by illuminating one or more of the indicators 30. The user may then inhale off the mouthpiece 120 to produce the low-pressure needed to increase vapor production. Due to the design of the electronic vaporizer 20, a low-pressure zone is created above the atomizer 60 by the fast-moving airflow, which promotes the phase-change of the liquid material into vapor. The user may then inhale the vapor through the mouthpiece 120 and can vary the amount of vapor produced by pressing on the airflow valve 102 of the quick connect adapter 100. Actuating the valve 102 allows more airflow into the atomizer 60, thus increasing the pressure and reducing the amount of produced vapor.

To power up (or turn on) the electronic vaporizer 10, the user actuates the button/switch 28 a predetermined number of times, e.g., 5. Once powered up, the current battery level is shown using the indicators 30.

The desired temperature may also be set or cycled through a plurality of predetermined or preset temperatures, using the switch/button 28. Each one of the preset temperatures has an associated color which is displayed using one or more of the LED bands 24A, 24B, 24C and/or the button/switch to indicate the selected temperature and to indicate when the temperature has been reached. The switch/button 28 may also be used to turn on/off decorative lighting features.

After material has been loaded into the crucible 62, the user may press/hold the switch/button 28 to initiate heating process. After the switch/button 28 has been pressed for a predetermined amount of time, one or more of the LED bands 24A, 24B, 24C may be illuminated a specific color, e.g., red, to indicate the initiate the heating process. Once the desired temperature has been reached, the one or more of the LED bands may be responsively illuminated using a different color, e.g., green.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A quick connect adapter for use in an electronic vaporizer, the electronic vaporizer having a main unit, an atomizer removably coupled to the main unit and a removable mouthpiece, the quick connect adapter comprising:

a quick connect adapter housing at least partially defining an inner channel and being configured to be positioned between the atomizer and the removable mouthpiece, the inner channel having a first open end and a second open end, the quick connect adapter housing having an interior cavity and a valve aperture for receiving a valve configured to be operated by a user to control a flow of ambient air through the valve into the interior cavity of the quick connect adapter housing;

an air flow path defined by the quick connect adapter housing to allow vapor to flow from the atomizer to the mouthpiece; and, a mouthpiece quick release connector coupled to, and located adjacent, the first end of the quick connect adapter housing, the mouthpiece quick release connecter configured to allow the mouthpiece to be releasably coupled to the main unit via the quick connect adapter.

2. The quick connect adapter, as set forth in claim 1, further comprising an adapter connector coupled to, and located adjacent, the second end of the quick connect adapter housing, the adapter connector configured to allow the quick connect adapter to be releasably coupled to the main unit.

3. The quick connect adapter, as set forth in claim 2, wherein the adapter connector comprises a magnet coupled to the second end of the quick connect adapter housing.

4. The quick connect adapter, as set forth in claim 2, wherein the adapter connector is a physical connector.

5. The quick connect adapter, as set forth in claim 1, wherein the mouthpiece connector includes a flexible seal coupled to the first end of the quick connect adapter housing.

6. The quick connect adapter, as set forth in claim 5, wherein the flexible seal is a silicon seal.

7. An electronic vaporizer, comprising:

a main unit;

an atomizer coupled to the main unit;

a quick connect adapter removably removable coupled to the main unit;

a mouthpiece removably coupled to the main unit via the quick connect adapter, the quick connect adapter including:

a quick connect adapter housing at least partially defining an inner channel and being configured to be positioned between the atomizer and the removable mouthpiece, the inner channel having a first open end and a second open end, the quick connect adapter housing having an interior cavity and a valve aperture;

an air flow path defined by the quick connect adapter housing to allow vapor to flow from the atomizer to the mouthpiece; and, a mouthpiece quick release connector coupled to, and located adjacent, the first end of the quick connect adapter housing, the mouthpiece quick release connecter configured to allow the mouthpiece to be releasably coupled to the main unit via the quick connect adapter; and, a valve positioned within the valve aperture, the valve configured to be operated by a user to control a flow of ambient air through the valve into the interior cavity of the quick connect adapter housing and into the inner channel.

8. The electronic vaporizer, as set forth in claim 7, wherein the valve is one of spring valve, a knob valve and an on/off plug valve.

9. The electronic vaporizer, as set forth in claim 7, wherein the quick connect adapter further comprises an adapter connector coupled to, and located adjacent, the second end of the quick connect adapter housing, the adapter connector configured to allow the quick connect adapter to be releasably coupled to the main unit.

10. The electronic vaporizer, as set forth in claim 9, wherein the adapter connector comprises a magnet coupled to the second end of the quick connect adapter housing.

11. The electronic vaporizer, as set forth in claim 9, wherein the adapter connector is a physical connector.

12. The electronic vaporizer, as set forth in claim 7, wherein the mouthpiece connector includes a flexible seal coupled to the first end of the quick connect adapter housing.

13. The electronic vaporizer, as set forth in claim 12, wherein the flexible seal is a silicon seal.

14. An electronic vaporizer, comprising:

a main unit;

an atomizer coupled to the main unit;

a quick connect adapter removably removable coupled to the main unit; and, a mouthpiece removably coupled to the main unit via the quick connect adapter, the quick connect adapter including:

a quick connect adapter housing at least partially defining an inner channel and being configured to be positioned between the atomizer and the removable mouthpiece, the inner channel having a first open end and a second open end, the quick connect adapter housing having an interior cavity;

an air flow path defined by the quick connect adapter housing to allow vapor to flow from the atomizer to the mouthpiece; and, a mouthpiece quick release connector coupled to, and located adjacent, the first end of the quick connect adapter housing, the mouthpiece quick release connecter configured to allow the mouthpiece to be releasably coupled to the main unit via the quick connect adapter.

15. The electronic vaporizer, as set forth in claim 14, wherein the quick connect adapter further comprises an adapter connector coupled to, and located adjacent, the second end of the quick connect adapter housing, the adapter connector configured to allow the quick connect adapter to be releasably coupled to the main unit.

16. The electronic vaporizer, as set forth in claim 15, wherein the adapter connector comprises a magnet coupled to the second end of the quick connect adapter housing.

17. The electronic vaporizer, as set forth in claim 15, wherein the adapter connector is a physical connector.

18. The electronic vaporizer, as set forth in claim 14, wherein the mouthpiece connector includes a flexible seal coupled to the first end of the quick connect adapter housing.

19. The electronic vaporizer, as set forth in claim 18, wherein the flexible seal is a silicon seal.

* * * * *